US005537110A

United States Patent [19]

Iida et al.

[11] Patent Number: 5,537,110

[45] Date of Patent: Jul. 16, 1996

[54] VEHICLE DETECTING SYSTEM

[75] Inventors: Yasuhisa Iida; Masayoshi Konishi, both of Takasago; Ichiro Fujita; Hideo Uehara, both of Kobe; Seiki Kato, Takasago; Riichiro Yamashita, Takasago; Hiroyuki Nakayama, Takasago, all of Japan

[73] Assignee: Mitsubishi Jukogyo Kabushiki Kaisha, Tokyo, Japan

[21] Appl. No.: 194,352

[22] Filed: Feb. 10, 1994

[30] Foreign Application Priority Data

Feb. 19, 1993 [JP] Japan ..... 5-030247
Feb. 19, 1993 [JP] Japan ..... 5-030248

[51] Int. Cl.[6] ..... G08G 1/04

[52] U.S. Cl. ..... 340/942; 340/933; 340/937; 364/436

[58] Field of Search ..... 340/942, 936, 340/933, 937, 941, 939; 364/436

[56] References Cited

U.S. PATENT DOCUMENTS

| | | | |
|---|---|---|---|
| 3,290,490 | 12/1966 | Auer | 340/936 |
| 3,436,540 | 4/1969 | Lamorlette | 340/942 |
| 3,516,056 | 6/1970 | Matthews | 340/942 |
| 3,532,886 | 10/1970 | Kruger et al. | 340/933 |
| 3,748,443 | 7/1973 | Kroll et al. | 235/92 |
| 3,840,848 | 10/1974 | Manshall et al. | 340/942 |
| 4,247,768 | 1/1981 | Elmer et al. | 340/942 |
| 4,789,941 | 12/1988 | Nunberg | 340/933 |
| 4,808,997 | 2/1989 | Barkley et al. | 340/942 |
| 4,947,353 | 8/1990 | Quinlan | 340/942 |
| 5,008,666 | 4/1991 | Gebert et al. | 340/936 |
| 5,066,950 | 11/1991 | Schweitzer et al. | 340/936 |
| 5,134,393 | 7/1992 | Hensm | 340/933 |
| 5,204,675 | 4/1993 | Sekine | 340/937 |
| 5,392,034 | 2/1995 | Kuwagaki | 340/942 |

FOREIGN PATENT DOCUMENTS

| | | | |
|---|---|---|---|
| 0563516 | 10/1993 | European Pat. Off. | 340/942 |
| 1261025 | 2/1968 | Germany . | |
| 1294726 | 5/1969 | Germany | 340/942 |

*Primary Examiner*—Brent A. Swarthout
*Assistant Examiner*—Nina Tong
*Attorney, Agent, or Firm*—Jacobson, Price, Holman & Stern

[57] ABSTRACT

The object of the present invention is to accurately detect vehicles even under special conditions where vehicles go side by side, a motorcycle passes another vehicle in a traffic jam, or a shadow is cast on the road surface. The vehicle detecting system comprises a one dimension CCD camera 2 mounted above a road surface so as to provide one dimension light amount signal in the lane width direction from above the road surface and intermittent markings 6 disposed in the field of view of the one dimension CCD camera. When a vehicle 3 enters the field of view of the one dimension CCD camera 2, the modulation of one dimension light amount signal is disturbed. Therefore, a signal processing device 5 detects the vehicle on the basis of the output signal of the one dimension CCD camera 2 by checking the disturbance of modulation.

6 Claims, 25 Drawing Sheets

| |
|---|
| FIG. 8(a) |
| FIG. 8(b) |
| FIG. 8(c) |
| FIG. 8(d) |

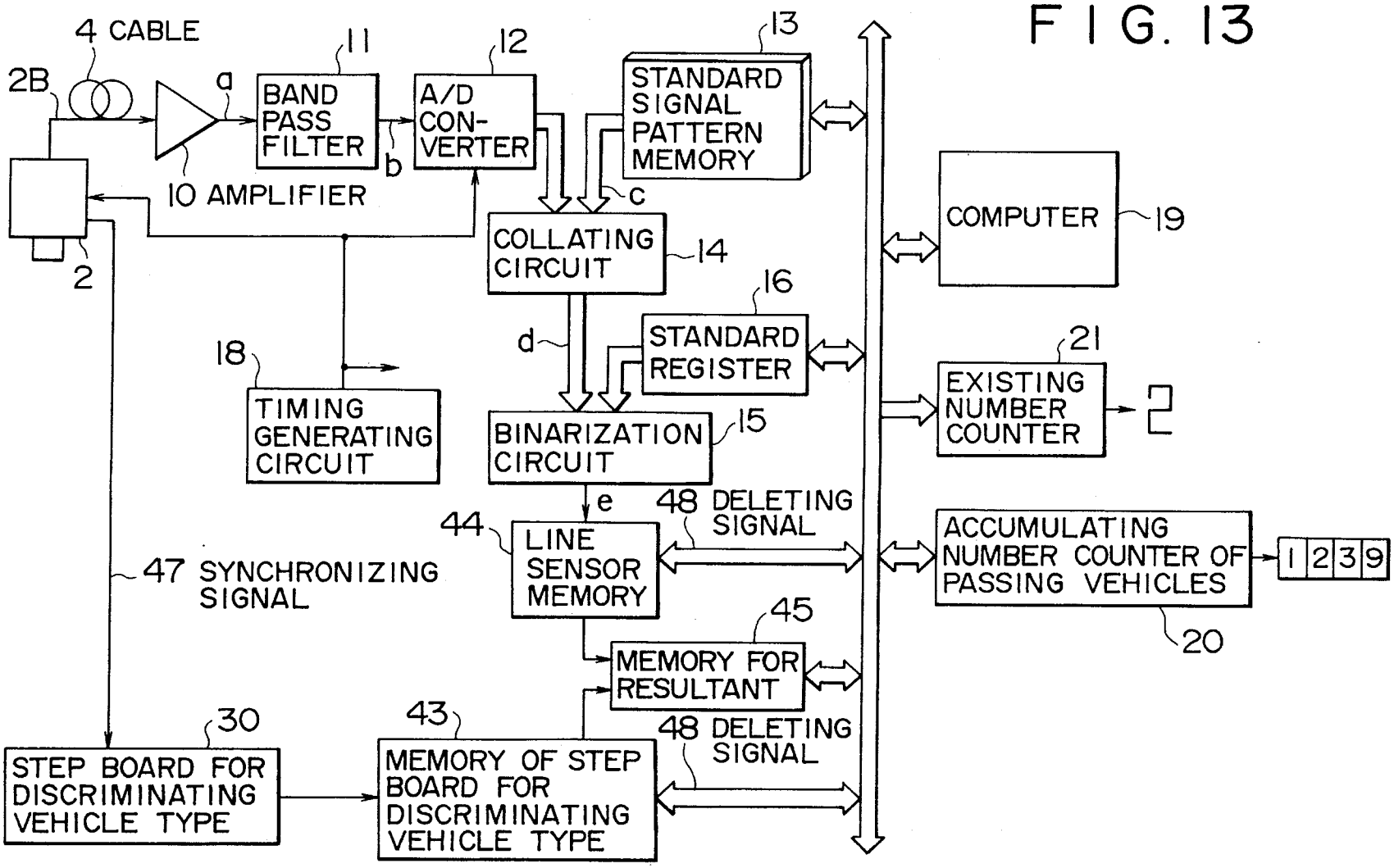
FIG. 13
COMPUTER
19
EXISTING NUMBER COUNTER
21
ACCUMULATING NUMBER COUNTER OF PASSING VEHICLES
20
1 2 3 9
STANDARD SIGNAL PATTERN MEMORY
13
STANDARD REGISTER
16
COLLATING CIRCUIT
14
BINARIZATION CIRCUIT
15
48 DELETING SIGNAL
LINE SENSOR MEMORY
44
MEMORY FOR RESULTANT
45
48 DELETING SIGNAL
MEMORY OF STEP BOARD FOR DISCRIMINATING VEHICLE TYPE
43
A/D CON-VERTER
12
BAND PASS FILTER
11
TIMING GENERATING CIRCUIT
18
47 SYNCHRONIZING SIGNAL
STEP BOARD FOR DISCRIMINATING VEHICLE TYPE
30
10 AMPLIFIER
4 CABLE
2B
2
a
b
c
d
e

VEHICLE DETECTING SYSTEM

FIELD OF THE INVENTION AND RELATED ART STATEMENT

The present invention relates to a vehicle detecting system which is used for toll machines for toll roads and for traffic equipment for traffic survey, etc.

There are three conventional systems in which passing vehicles on the road are detected and counted from above the road surface:

(1) Ultrasonic System

With this system, a piezoelectric transducer which transmits and receives ultrasonic wave is mounted above the road surface to detect the distance to the road surface. When a vehicle passes through, the length of time taken for reflected echo to return becomes short, so that the presence of the vehicle can be detected.

(2) Microwave System

With this system, the frequency of reflected wave corresponding to the transmitted microwave is measured. The wave reflected back from a passing vehicle is subjected to doppler shift (frequency shift), while the wave reflected back from the road surface is not subjected to frequency shift. Therefore, the passing of a vehicle can be detected by detecting the frequency shift.

(3) Optical System

This system monitors the illuminance of road surface by using a photosensor. When a vehicle passes through, the system detects the vehicle because the roof paint color of the vehicle is different from the color of road surface. With the optical system, the field of view can be reduced by using an optical lens, or multiple detection can be carried out by using an array of photosensors.

The above-described conventional vehicle detecting techniques pose the following problems:

In the ultrasonic and microwave systems, long wavelength increases the beam width, so that the system widely covers the lane under the mounting position. Therefore, even if a small vehicle such as a motorcycle passes through anywhere on the lane just under the sensor, the system can detect the vehicle.

Thus, these systems have an advantage of covering the entire width of one lane with one sensor, but they cannot count a plurality of motorcycles separately when the motorcycles go side by side on the same lane. Also, these systems cannot detect a motorcycle passing the side of a truck on a jammed road. As described above, the system using ultrasonic wave or microwave has a limitation in accurate detection of passing vehicles.

Such miscounting is not permissible when the system is applied to a toll machine on a toll road, though it does not present a particularly big problem when the system is used for traffic survey to control the signal lights at intersections.

The optical system, unlike the microwave and ultrasonic systems, is based on beam of light. Therefore, this system can separately count motorcycles going side by side if photosensors are mounted at short intervals so that the field of view is decreased in the width direction in a lane.

In this case, however, two motorcycles going side by side may be regarded as one vehicle in detection at a certain time of day because the shadow of one vehicle is cast upon the road surface when the sun is at a low position in the morning or evening.

OBJECT AND SUMMARY OF THE INVENTION

The present invention was made in view of the above situation. Accordingly, an object of the present invention is to provide a vehicle detecting system which solves the above problems and is less affected by vehicles going side by side on a lane, traffic conditions such as jamming, and weather conditions.

To achieve the above object, the constitution of the present invention is as follows:

(1) The vehicle detecting system of the present invention is characterized by comprising, an optical array sensor which is disposed above a road surface to receive one dimension light amount signal in the lane width direction from the road surface; optical equipment, such as a lens, which is mounted to the optical array sensor; intermittent markings which are disposed at fixed intervals on the road surface in the one dimension field of view of the optical array sensor; and a signal processing device which detects vehicles passing through on the road surface by processing the output signal sent from the optical array sensor.

(2) The vehicle detecting system of the present invention is characterized by comprising, a marking projecting device which includes a laser light source and a diffraction grating mounted above a road surface in order to project stripe-pattern intermittent marking images in the lane width direction onto the road surface; an optical array sensor which is mounted above the road surface so as to have an optical axis in nonparallel with the optical axis of the marking projecting device, and receives a one dimension (linear) light amount signal of the intermittent marking images in the lane width direction from the road surface; optical equipment, such as a lens, which is mounted to the optical array sensor; and a signal processing device which detects vehicles passing through on the road surface by processing the output signal sent from the optical array sensor.

In this case, preferably, the intermittent period interval of intermittent markings or the intermittent marking images should be longer than the on-road period interval of picture elements of the optical array sensor, and shorter than the minimum width of the vehicle to be detected. Preferably, at least one sensor out of a step board which is embedded in the road surface and has a contact operated by a wheel of vehicle, a loop coil which is embedded in the road surface, an ultrasonic wave transmitter/receiver which is mounted above the road surface, and a microwave transmitter/receiver which is mounted above the road surface, should be further comprised so that the signal processing device detects vehicles from the output signal of the sensor and the output signal of the optical array sensor.

The operation of the present invention is as follows.

(1) In the aforesaid constitution (1) of the present invention, the optical light sensor and the optical equipment such as a lens receive the one dimension (linear) light amount signal in the lane width direction from the road surface. The intermittent markings on the road surface, which add modulation to one dimension light amount signal, are used to judge, according to the disturbance of modulation, whether a vehicle is actually present on the road surface or no vehicle is present and only a shadow of vehicle passing through the adjacent lane lies. The signal processing device processes the one dimension light amount signal by taking advantage of the presence of modulation added by the intermittent markings, and separates and discriminates between the background road surface and a passing vehicle, so that the passing of individual vehicle is detected.

(2) In the aforesaid constitution (2) of the present invention, the laser light source is a light source for providing markings on the road surface, and the diffraction grating gives the laser beam with a stripe-pattern, so that intermittent marking images are projected on the road surface. The array sensor receives the one dimension (linear) light amount signal in the lane width direction of intermittent marking images reflected on the road surface. The signal processing device processes the one dimension light amount signal from the optical array sensor by taking advantage of the fact that the marking images on the passing vehicle is reflected by the vehicle and not return to the optical array sensor, and separates the passing vehicle from the background road surface and discriminates between them by changing of signal into stripe pattern, so that the passing of individual vehicle is detected.

As described above, according to the present invention, by using the optical array sensor and the intermittent markings or the optical array sensor and the marking projecting device for producing intermittent marking images and the signal processing device, a vehicle can be detected accurately even under special conditions where vehicles go side by side, a motorcycle passes another vehicle in a traffic jam, or a shadow is cast on the road surface.

BRIEF DESCRIPTION OF THE DRAWINGS

In the drawings,

FIG. 13 is a block diagram showing a typical configuration of a signal processing device, corresponding to FIG. 5.

DETAILED DESCRIPTION OF PREFERRED EMBODIMENTS

First Embodiment

Figure 1:
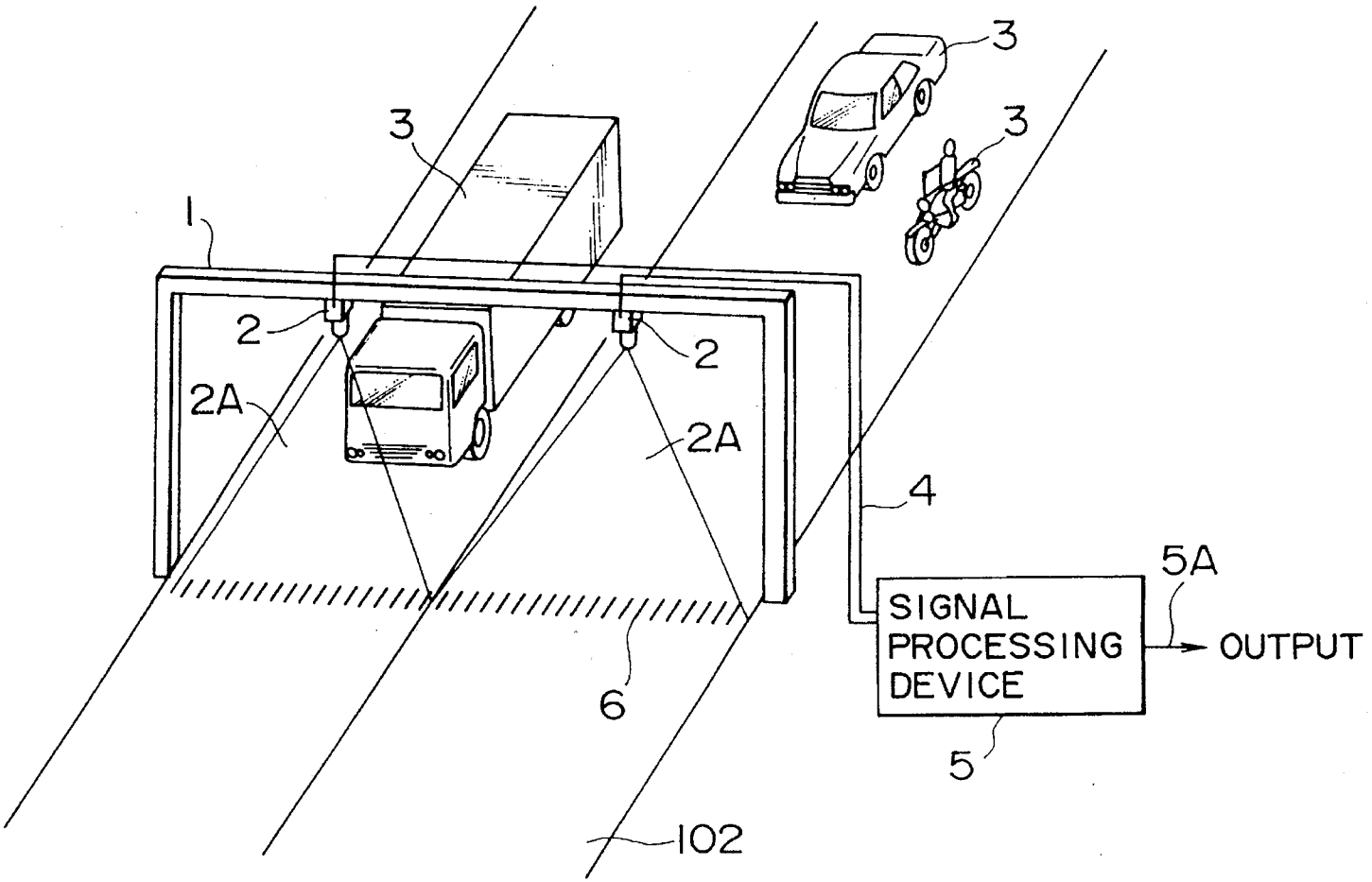
FIG. 1 is a schematic view of a vehicle detecting system in accordance with a first embodiment of the present invention.

A first embodiment of the present invention will be described below with reference to the drawings. FIG. 1 is a schematic view of a vehicle detecting system in accordance with the first embodiment of the present invention. In FIG. 1, a gantry 1 is used to install equipment 2 above a road surface 102. The equipment 2 consists generally of optical equipment such as an optical array sensor and a lens. In this embodiment, the equipment 2 consists of a one dimension CCD (Charge Coupled Device) camera incorporating a one dimension CCD optical element. The one dimension CCD camera 2 is installed facing directly below for each lane. Each one dimension CCD camera 2 provides a field of view 2A of one dimension in the lane width direction in relation to the road surface 102. A plurality of one dimension CCD cameras may be used to provide a field of view covering the width of one lane. Reference numeral 3 denotes a passing vehicle. The output signal from the one dimension CCD camera 2 is transmitted to a signal processing device 5 via a cable 4, and the signal processing device 5 detects the passing vehicle 3. The signal processing device 5 outputs a pulse signal 5A each time one vehicle passes through. Intermittent markings 6 are periodic markings having fixed intervals, which are disposed at the part of field of view of the one dimension CCD camera 2 on the road surface 102. In this embodiment, reflecting paint is applied on the road surface 102 at fixed intervals to form intermittent markings 6.

Figure 2:
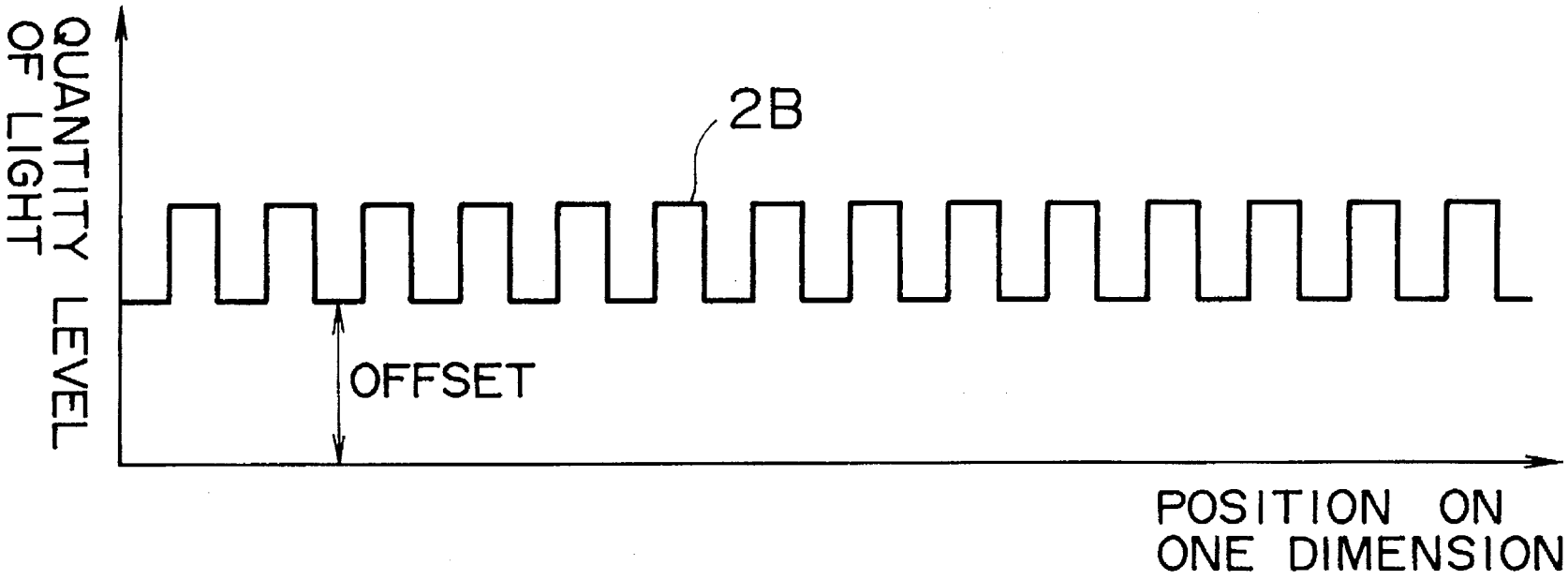
FIG. 2 is a view showing a typical waveform of incident light.

Next, the function of the aforesaid intermittent marking will be described with reference to FIGS. 2 to 4. FIG. 2 shows an example of output signal 2B obtained when the one dimension CCD camera 2 catches the road surface. Although the offset changes depending on the sunshine condition, a periodic signal modulated by markings 6 can be obtained.

Figure 3:
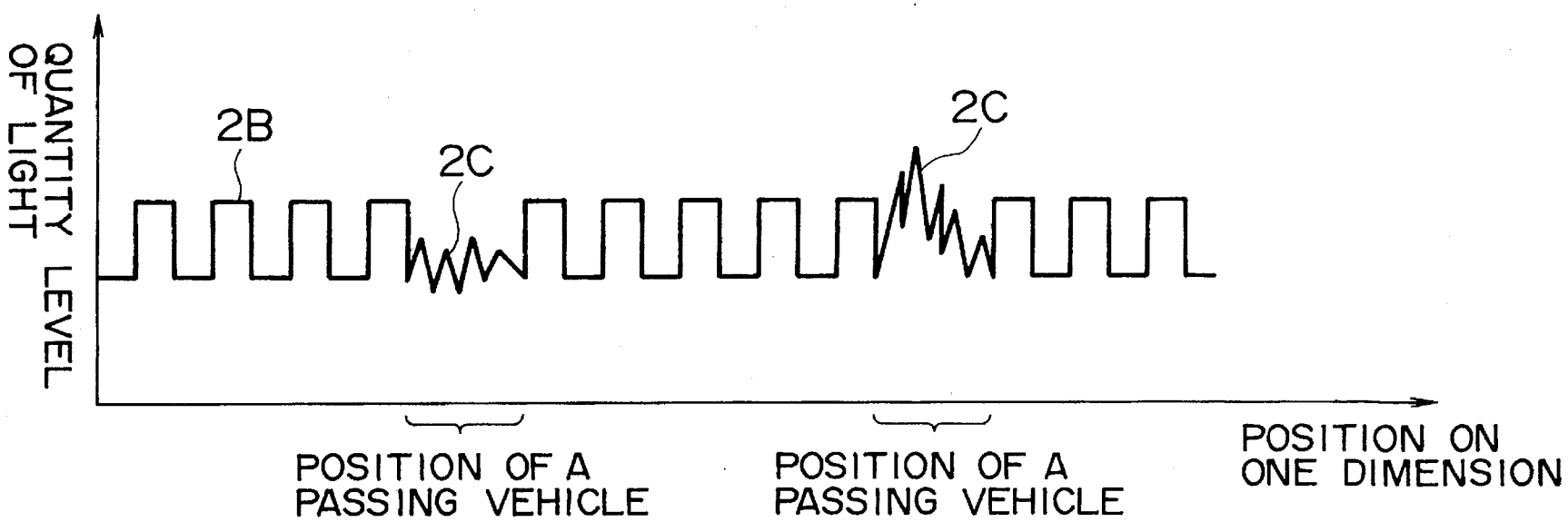
FIG. 3 is a view showing a typical waveform of incident light.
Figure 4:
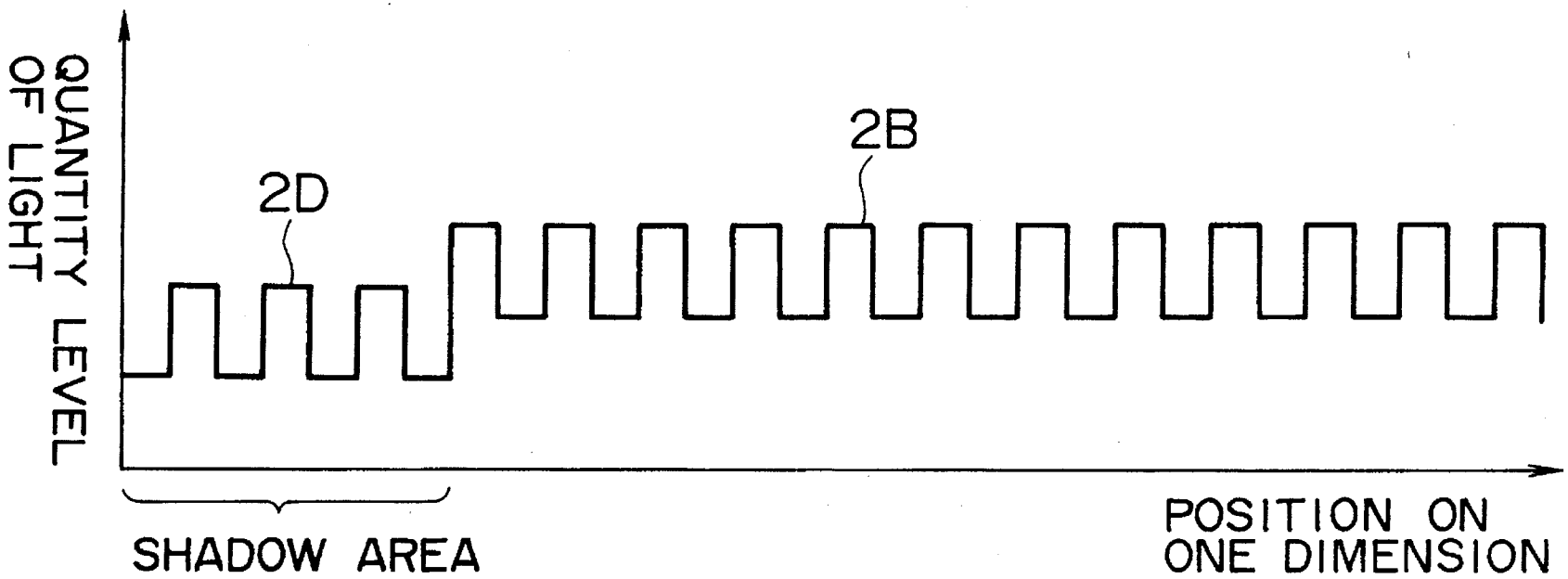
FIG. 4 is a view showing a typical waveform of incident light.

If a vehicle 3 passes through, the periodic signal is disturbed at the passing portion as indicated by reference character 2C in FIG. 3. From this disturbance, the position where the vehicle 3 passes through can be found. For example, even if two motorcycles go side by side, these can be separately detected since two disturbances 2C of periodic signal take place.

When there is no passing vehicle on the lane directly under the one dimension CCD camera 2 and a large truck passes through on the adjacent lane, the shadow of the truck is cast on the field of view of the one dimension CCD camera 2 depending on the direction of sun light. In this case, a waveform 2D is provided as shown in FIG. 4. At the shadow area 2D, the offset is reduced but the periodic signal does not disappear, so that it is found that there is no vehicle on this lane.

Thus, vehicles can be accurately detected on the basis of the periodic signal by detecting the disturbances of the signal.

Figure 5:
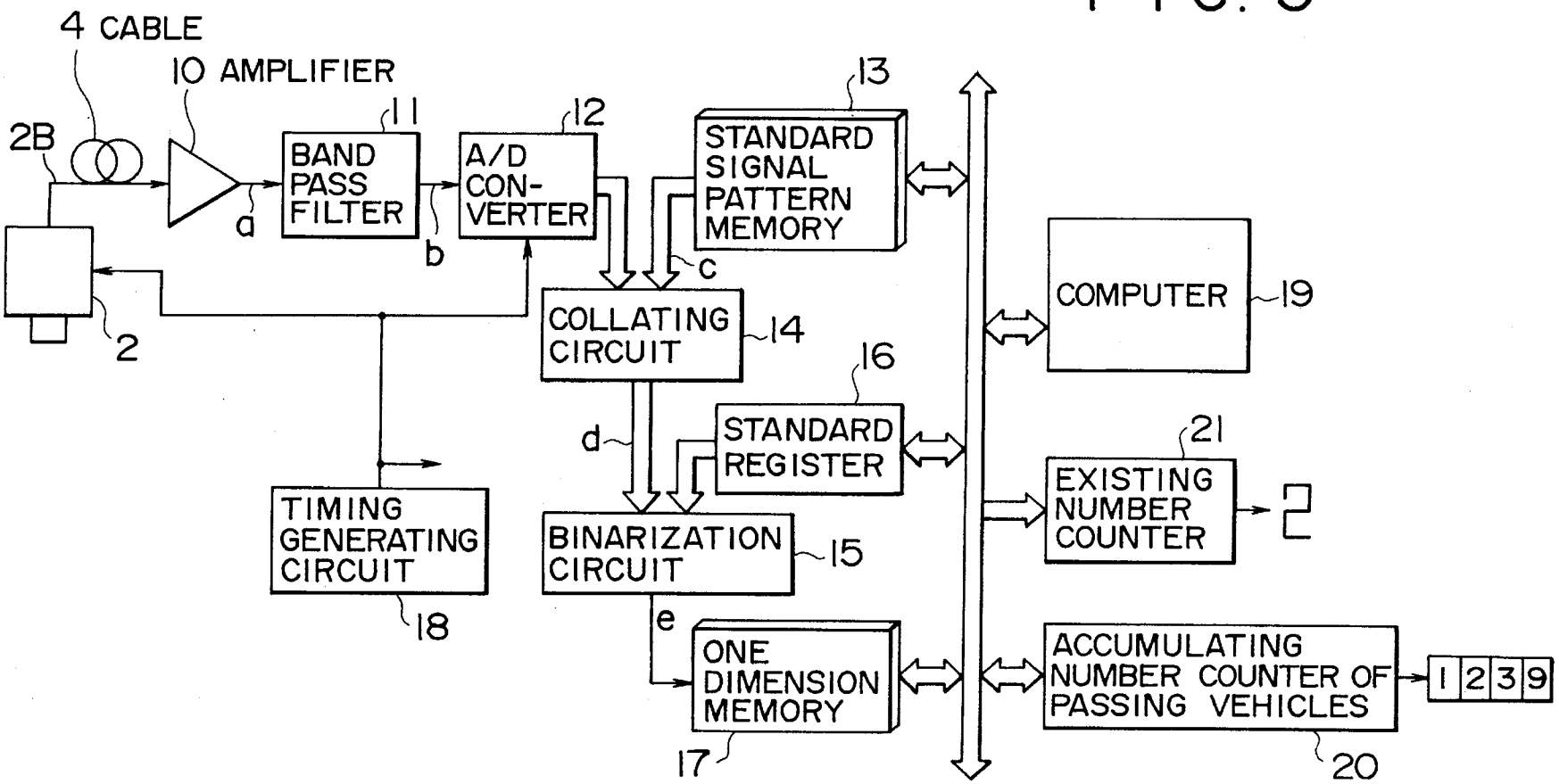
FIG. 5 is a block diagram showing a typical configuration of a signal processing device.
Figure 6A:
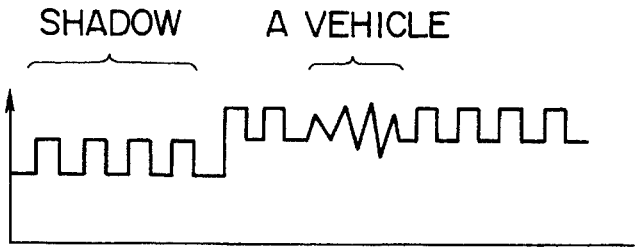
FIGS. 6*a*, 6*b*, 6*c*, 6*d*, 6*e* are a view showing typical waveforms at portions of the signal processing device.
Figure 6B:
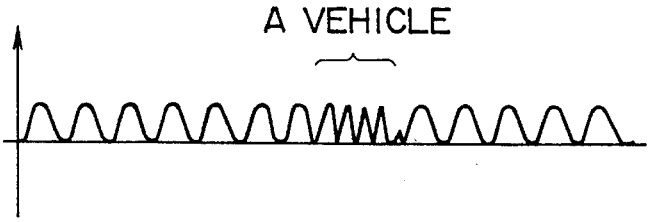
Figure 6C:
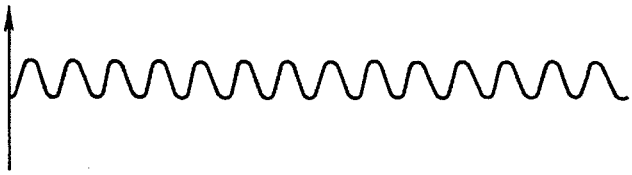
Figure 6D:
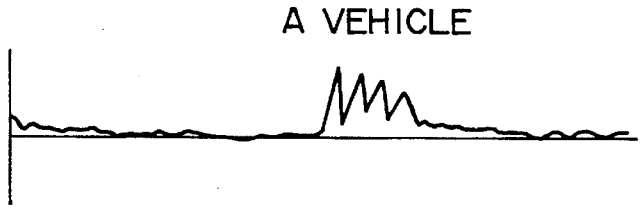
Figure 6E:
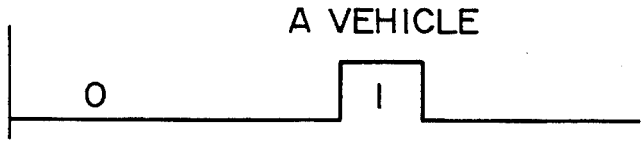

Next, a specific example of a signal processing device 5 will be described with reference to FIG. 5. The signal processing device 5 comprises an amplifier 10, a band pass filter 11, an A/D converter 12, a standard signal pattern memory 13, a collating circuit 14, a binarization circuit 15, a standard register 16, a one dimension memory 17, a timing generating circuit 18, and a computer 19.

The operation of the signal processing device 5 will be described. First, the output signal 2B sent from the one dimension CCD camera 2 is amplified by the amplifier 10. Then, the amplified signal a is passed through the band pass filter 11 to pass frequency components including period components of marking 6 and to remove low-frequency components due to sunshine and shadow. This signal b is digitized by the A/D converter 12. The standard signal pattern memory 13 stores a standard period pattern obtained when there is no vehicle on the road surface and all intermittent markings 6 lie in the field of view. The capacity of the memory is one dimension field of view. In the collating circuit 14, the road surface signal from the A/D converter 12 and a standard signal pattern c from the standard signal pattern memory 13 are inputted, and the period components are removed from the road surface signal of the A/D converter 12. The signal d from which period components are removed is added to the binarization circuit 15. The standard register 16 contains a standard value which constitutes one input of the binarization circuit 15. The binarization circuit 15 separates the signal so that, for example, the area where a vehicle is present is level "1" and the area of road surface is level "0". The signal e thus binarized is stored in the one dimension memory 17. Thus, when all the contents of one dimension memory 17 are "0", there is no vehicle on the road surface. The timing generating circuit 18 controls the entire timing of the interior of the signal processing device 5. The timing involves the synchronization signal of one dimension CCD camera 2, the conversion command signal of the A/D converter 12, the storage of data into the one dimension memory 17, and the notice to the computer 19. The signal processing device 5 generates the output of vehicle detection at the stage at which the content of the one dimension memory 17 changes from "0" to non-"0". The content of the one dimension memory 17 is successively updated on the basis of the signal of the timing generating circuit 18. The computer 19 controls the entire device and makes judgment. The computer 19 checks the content of the one dimension memory 17 to see if it is non-"0" each time the content of the one dimension memory 17 is updated, and detects the presence of vehicle when it is non-"0". FIG. 6 shows the waveforms of the signals a, b, c, d, and e at portions in FIG. 5.

Figure 7A:
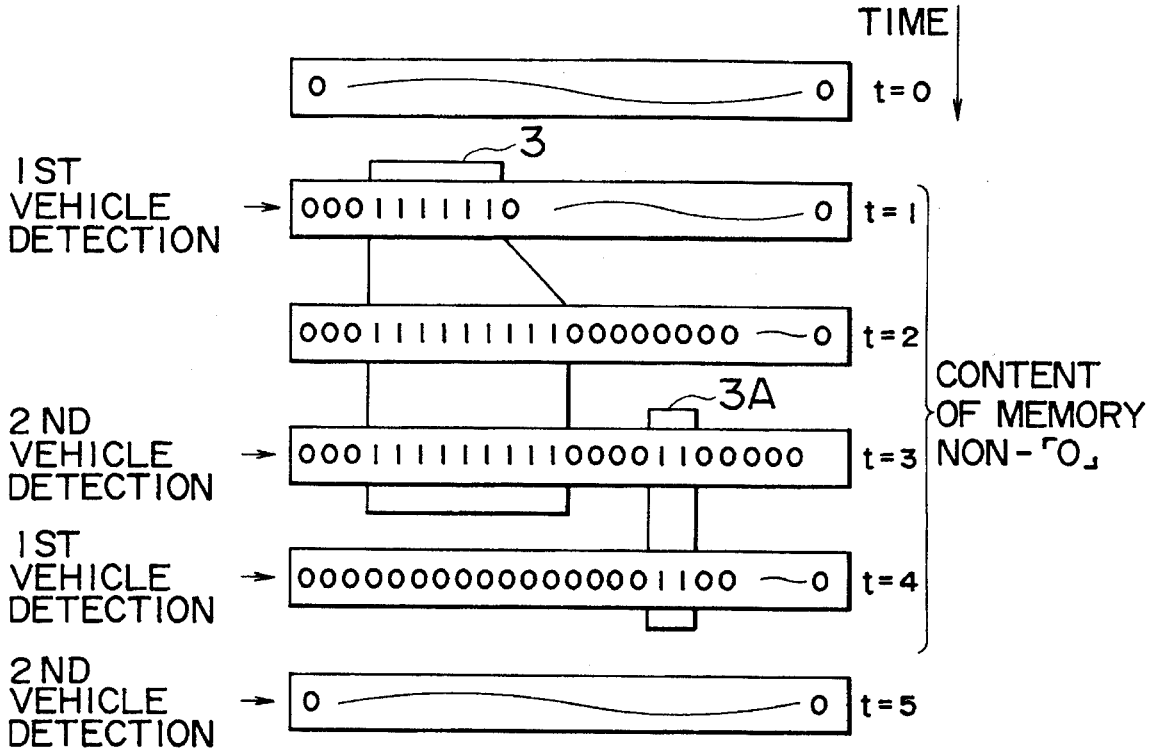
FIGS. 7*a* and 7*b* are a view showing the content of one dimension memory.
Figure 7B:
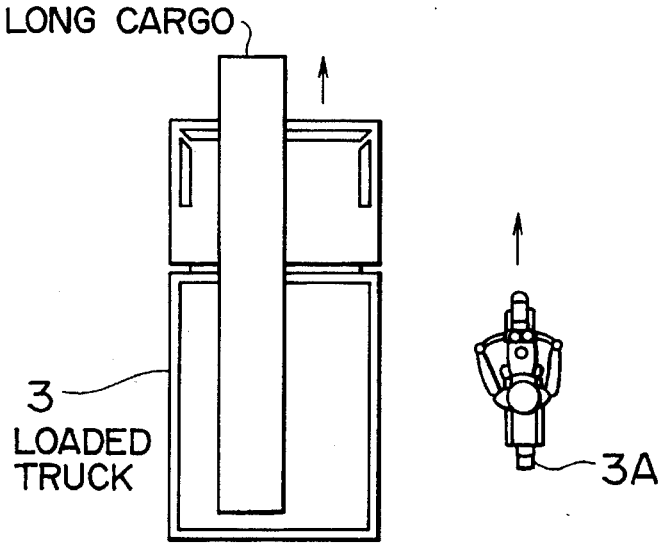
Figure 8A:
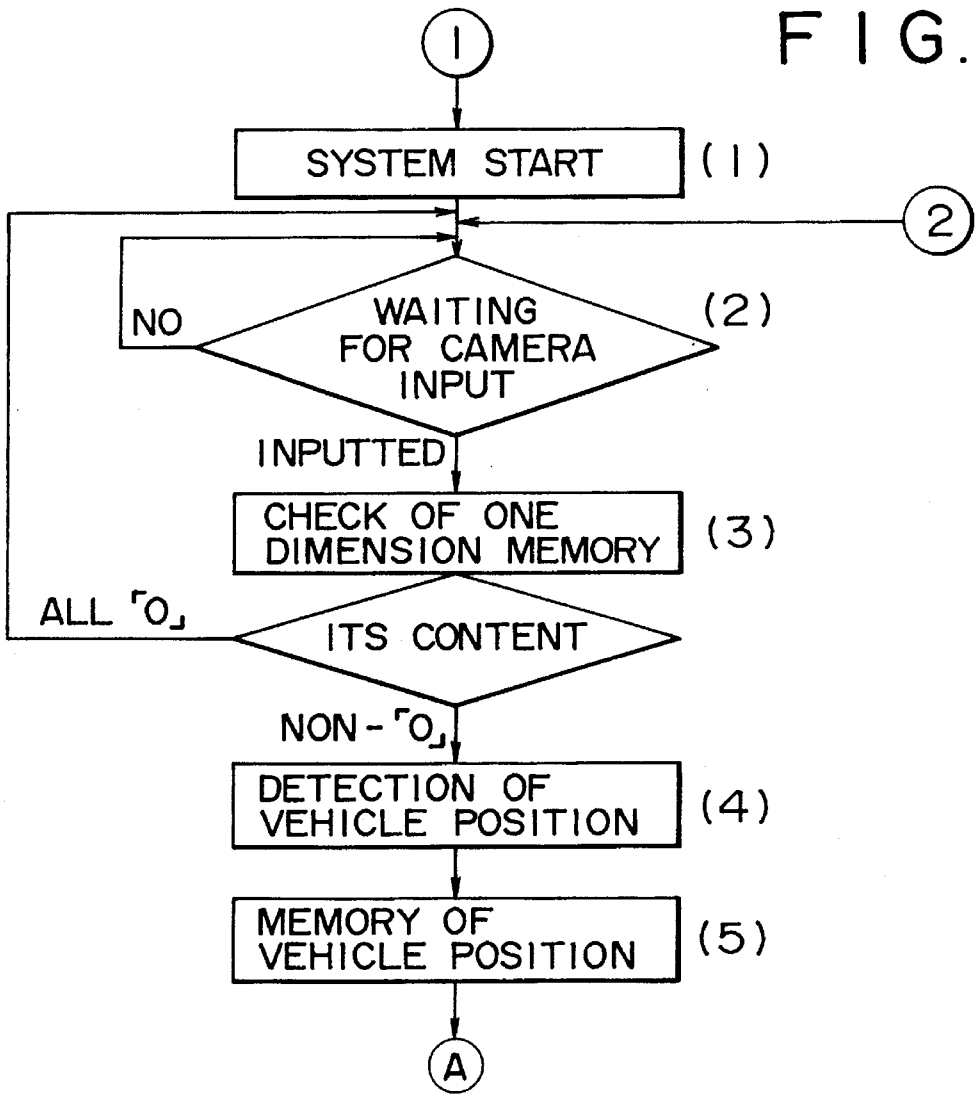
FIGS. 8*a*, 8*b*, 8*c*, 8*d* are a flowchart showing an example of signal processing procedure.
Figure 8B:
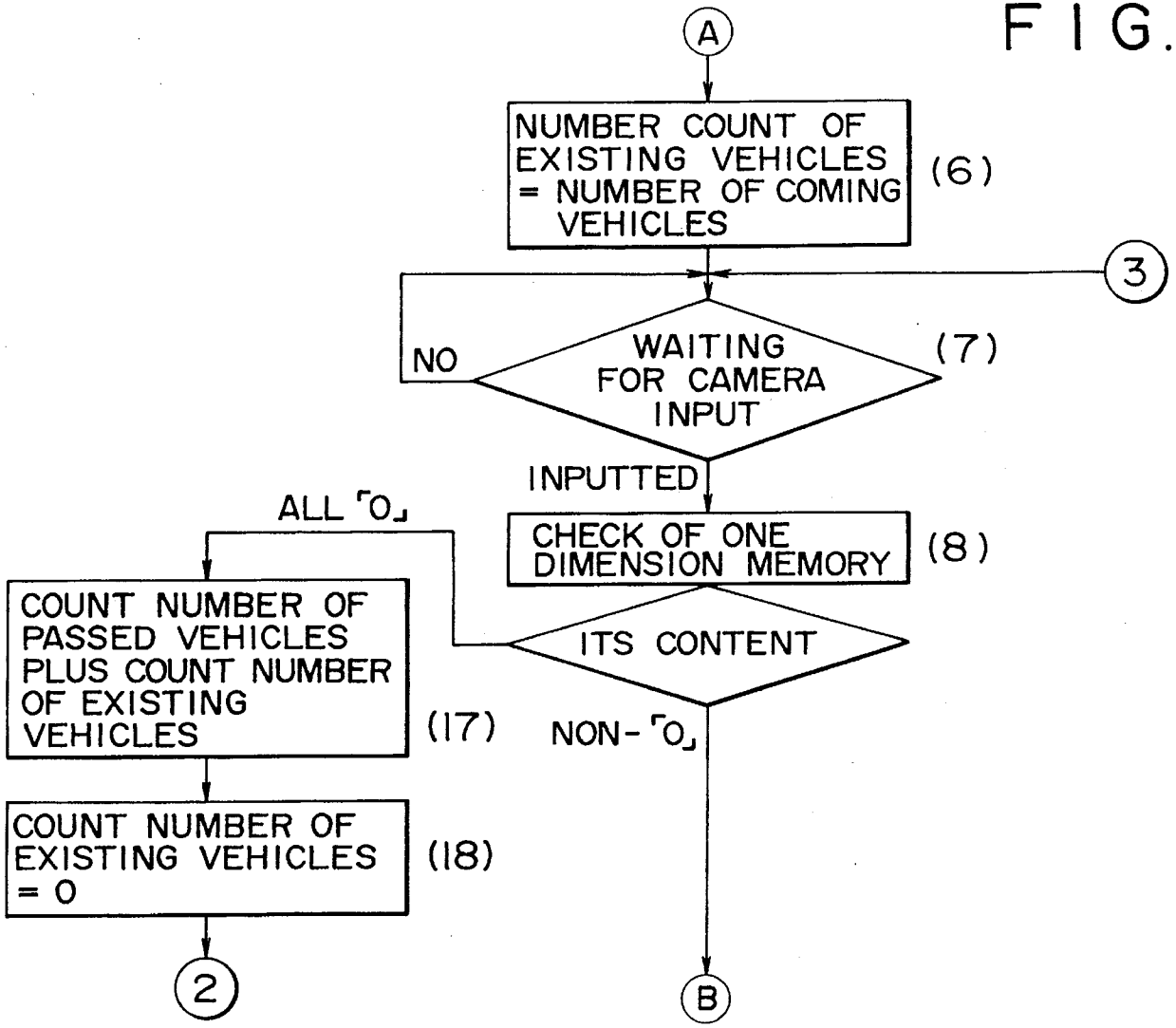
Figure 8C:
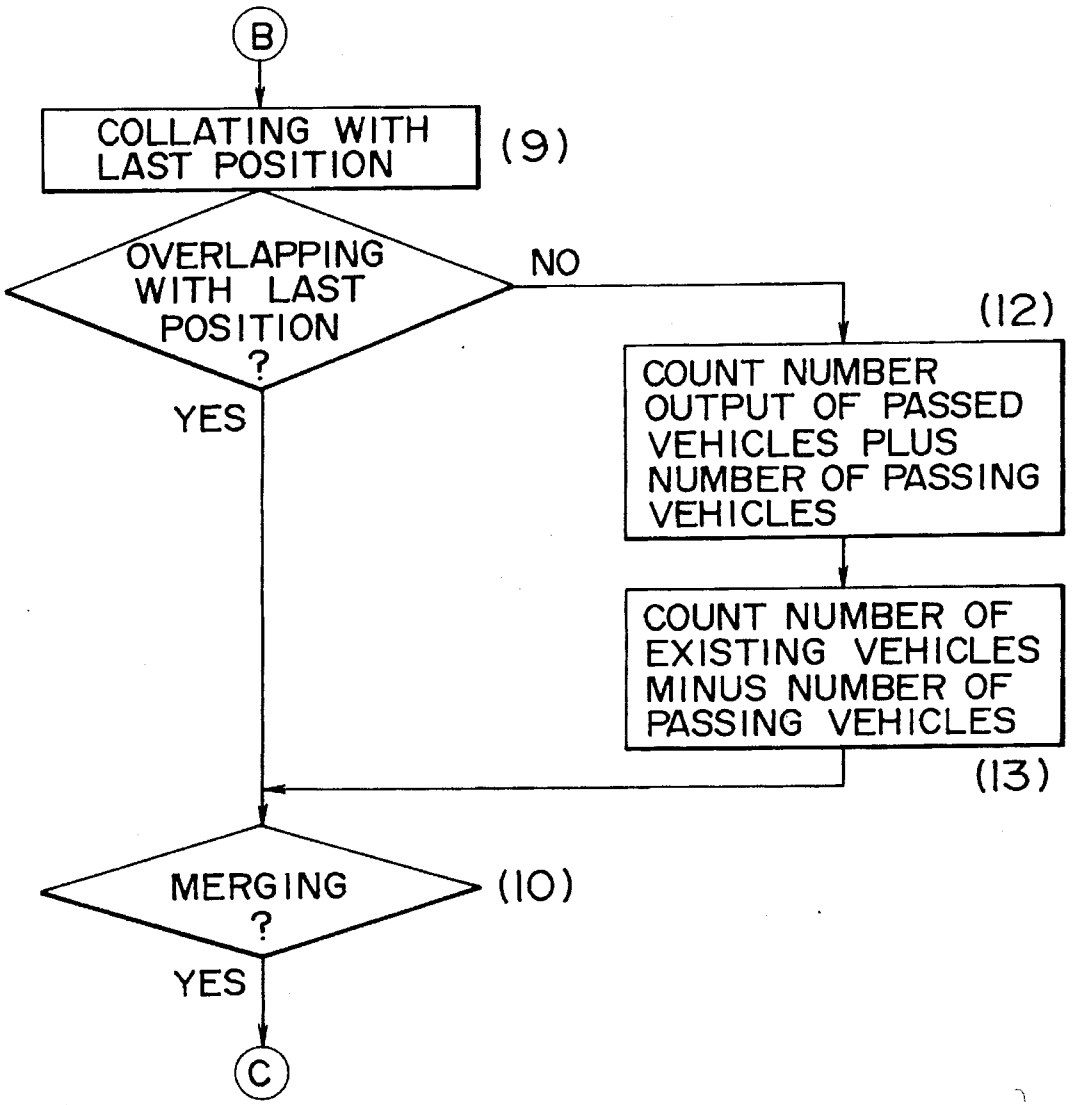
Figures 8, 8D:
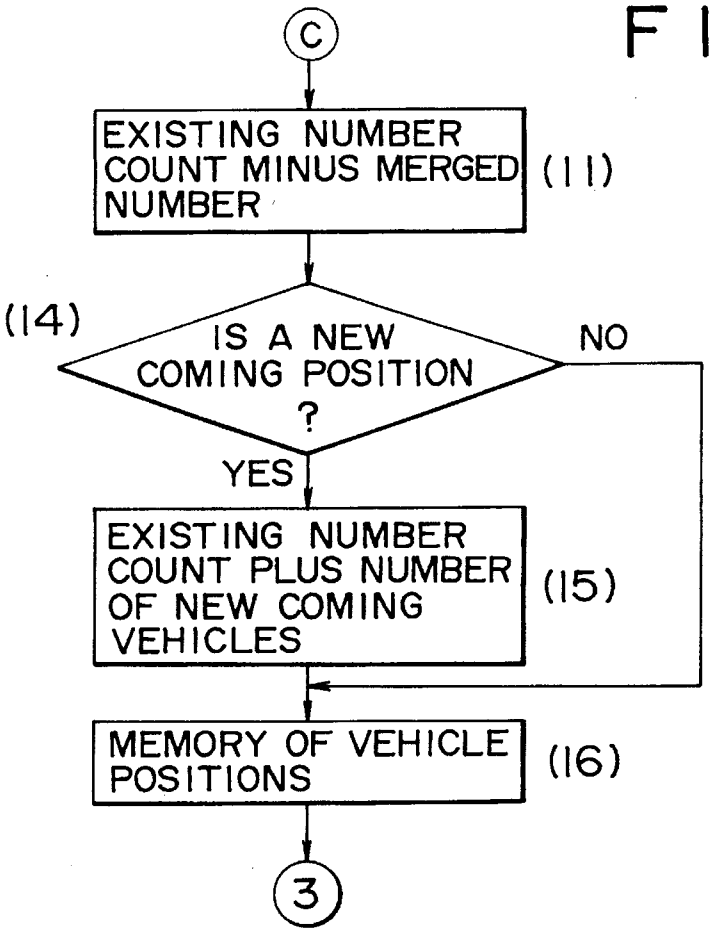

Next, the vehicle detecting procedure in the computer 19 will be described with reference to FIGS. 7 and 8. FIG. 7 shows the content of one dimension memory 17 with time, and FIG. 8 shows the flowchart for the vehicle detecting procedure.

As shown in FIG. 7, even if the content of the one dimension memory 17 is non-"0" as t=1 and t=2 due to one vehicle 3, when "1" region takes place at another position of the one dimension memory 17 with "0" being interposed as t=3, the coming of another vehicle 3A is detected. The computer 19 checks the content of the one dimension memory 17 each time the content thereof is updated. When it is found that there are groups of "1" separated into two regions, and these two groups are merged into one thereafter, the computer 19 rejudges that this indicates one vehicle. That is to say, the judgment ends when the vehicle leaves, not when the content of the one dimension memory 17 changes from all "0" to non-"0". If non-"0" area is changed into "0" in sequential updating and judgment, the computer 19 judges that the vehicle has passed through the detection region, canceling the output signal. The detection of the coming of vehicle includes the detection of the first and second vehicles, and the leaving of vehicle is also detected for each detected vehicle. Thus, the computer 19 judges the content of the one dimension memory 17 while comparing it with the content of the one dimension memory 17 obtained in the last detection. This means judgment by labeling each vehicle.

The output from the computer 19 is provided through an accumulating number counter 20 of passing vehicles and an existing number counter 21. The accumulating number counter 20 of passing vehicles counts up successively when one vehicle is detected. Therefore, this counter 20 indicates the accumulated number of passing vehicles. The existing number counter 21 indicates the number of vehicles which are present in the field of view of the CCD camera 2. Therefore, this counter 21 displays 2 when two motorcycles go side by side.

The processing in the aforesaid computer 19 will be described in detail with reference to the flowchart shown in FIG. 8. The system being started (1), the computer waits the entering of output signal sent from the one dimension CCD camera 2 (2). The output signal, if being entered, is processed by the vehicle judging circuit, and the computer checks the data stored in the one dimension memory (3). If all data are "0", the procedure returns to WAITING FOR CAMERA INPUT (2), and if there is non-"0", the computer proceeds to the next processing (3). Here, non-"0" is stored at a position where a vehicle enters, and "0" is stored at a position where a vehicle does not enter.

Next, the computer detects the vehicle coming position (4), and stores that vehicle position (5). After inputting the number of coming vehicles in the existing number counter (6), the computer waits the next signal sent from the one dimension CCD camera 2 (7). If the signal is inputted, the data in the one dimension memory are checked (8). If all data are "0", the computer judges that the all existing vehicles have passed through the detection region, adds the number of the existing number counter to the accumulating number counter of passing vehicles (17), clears the existing number counter to 0 (18), and returns to WAITING FOR CAMERA INPUT (2).

If there is non-"0", the data in the one dimension memory is collated with the last vehicle position (9). If there is a vehicle which does not overlap with the last position, that is, if the vehicles have passed through the detection region, the number of passing vehicles is added to the accumulating number counter of passing vehicles (12), and the number of passing vehicles is subtracted from the existing number counter (13).

If there is merging, that is, if the vehicles counted as two vehicles are found to be one vehicle (10), the merged number is subtracted from the existing number counter (11). Next, the computer checks if a vehicle is present at a new coming position (14). If no vehicle is present at a new coming position, the vehicle positions are stored (16), and the procedure returns to WAITING FOR CAMERA INPUT (7). If a vehicle is present at a new coming position, the number of newly coming vehicles is added to the existing number counter (15), the vehicle positions are stored (16), and the procedure returns to WAITING FOR CAMERA INPUT (7).

The size of the one dimension memory 17 is determined in relation to the number of picture elements of the photosensor composing the one dimension CCD camera 2. In principle, when a CCD camera with 1000 picture elements is used, the one dimension memory 17 should have a capacity of 1000 bits. In the case where the one dimension CCD camera 2 has 1000 picture elements, when the road width is 5000 mm, one picture element corresponds to 5 mm on the road surface.

Therefore, the period interval of intermittent markings 6 should be larger than each 5 mm interval of road surface corresponding to one picture element, and be smaller than the width of small vehicle such as a motorcycle. In the present invention, since a vehicle is detected by the disturbance of period in the output signal from the optical array sensor, if a vehicle with a minimum width of 500 mm is to be detected, markings having period intervals of about 2 to 5 periods per 500 mm are needed. If the markings have intervals of 5 periods, the period interval of the markings 6 on the road surface is 100 mm. That is to say, the period interval of the markings 6 is larger than one picture element of the CCD camera 2 and smaller than the minimum width of the passing vehicle 3.

As described above, by using a one dimension CCD camera 2 and intermittent markings 6, a vehicle can be detected accurately even under special conditions where vehicles go side by side, a motorcycle passes another vehicle in a traffic jam, or a shadow is cast on the road surface when the vehicle detecting system is applied to toll machines using a wireless IC card on the main lane of toll road or applied to traffic survey.

Next, a vehicle detecting system in accordance with another embodiment of the present invention will be described with reference to FIGS. 9 to 14.

Figure 9:
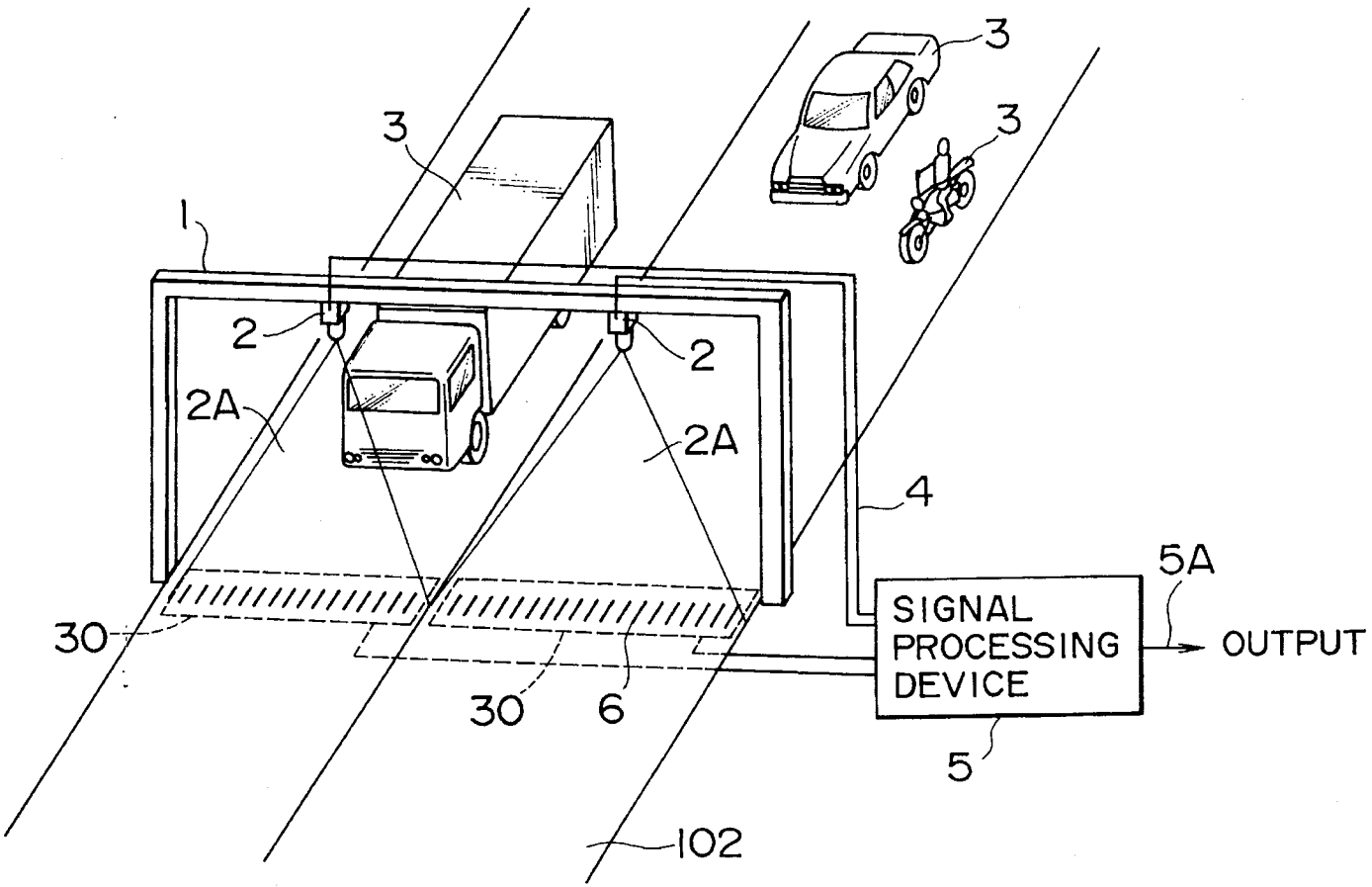
FIG. 9 is a schematic view of a vehicle detecting system in accordance with another embodiment of the present invention.

With the vehicle detecting system shown in FIG. 9, one or more step boards for discriminating vehicle type 30 are embedded in the road surface in each field of view of the one dimension CCD camera 2 as an auxiliary sensor for detecting a vehicle, in addition to the one dimension CCD camera 2, the signal processing device 5, and the intermittent markings 6 shown in FIG. 1. The signal processing device 5 detects a vehicle by using not only the signal sent from the one dimension CCD camera 2 but also the signal sent from the step board for discriminating vehicle type 30.

Figure 10:
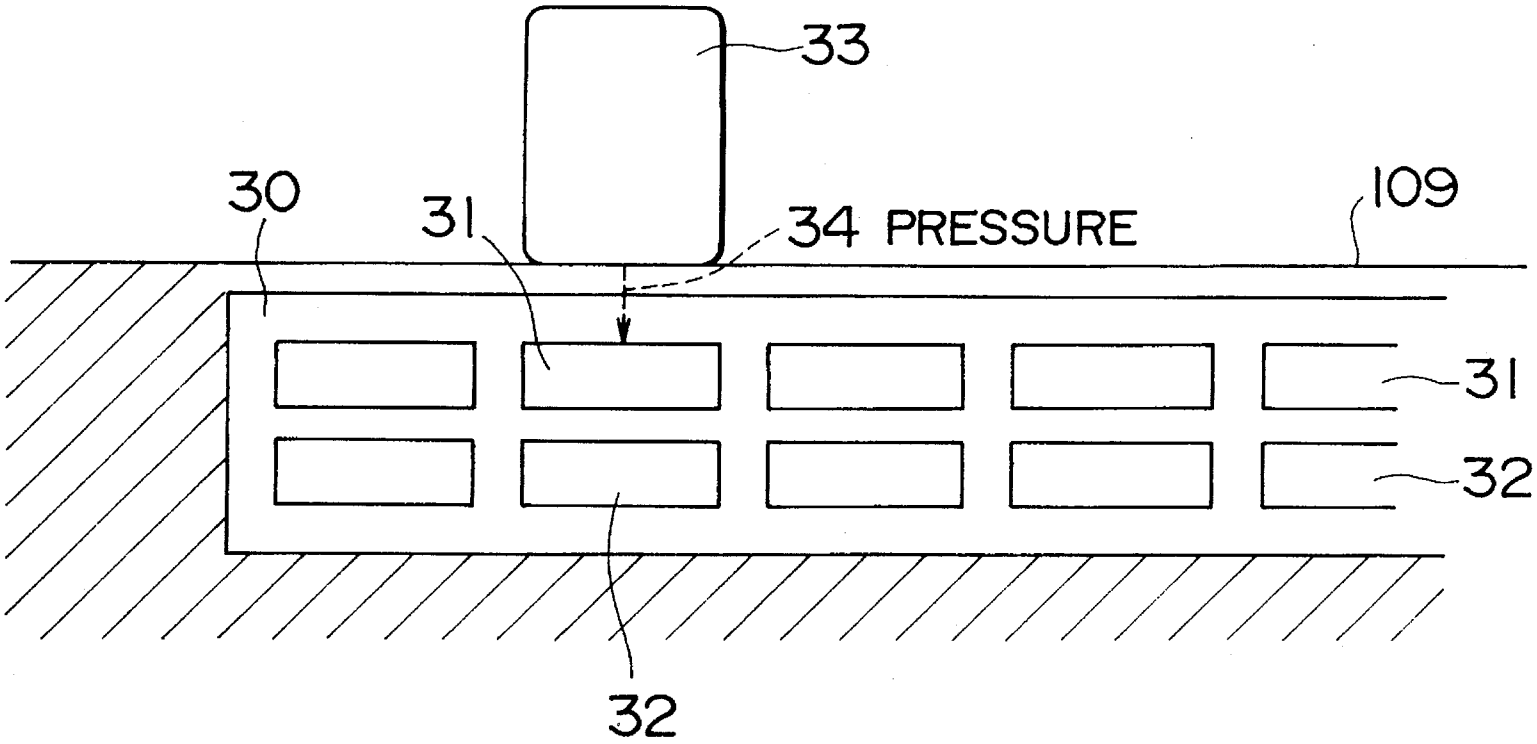
FIG. 10 is a view showing typical construction of a step board for discriminating vehicle type.
Figure 11:
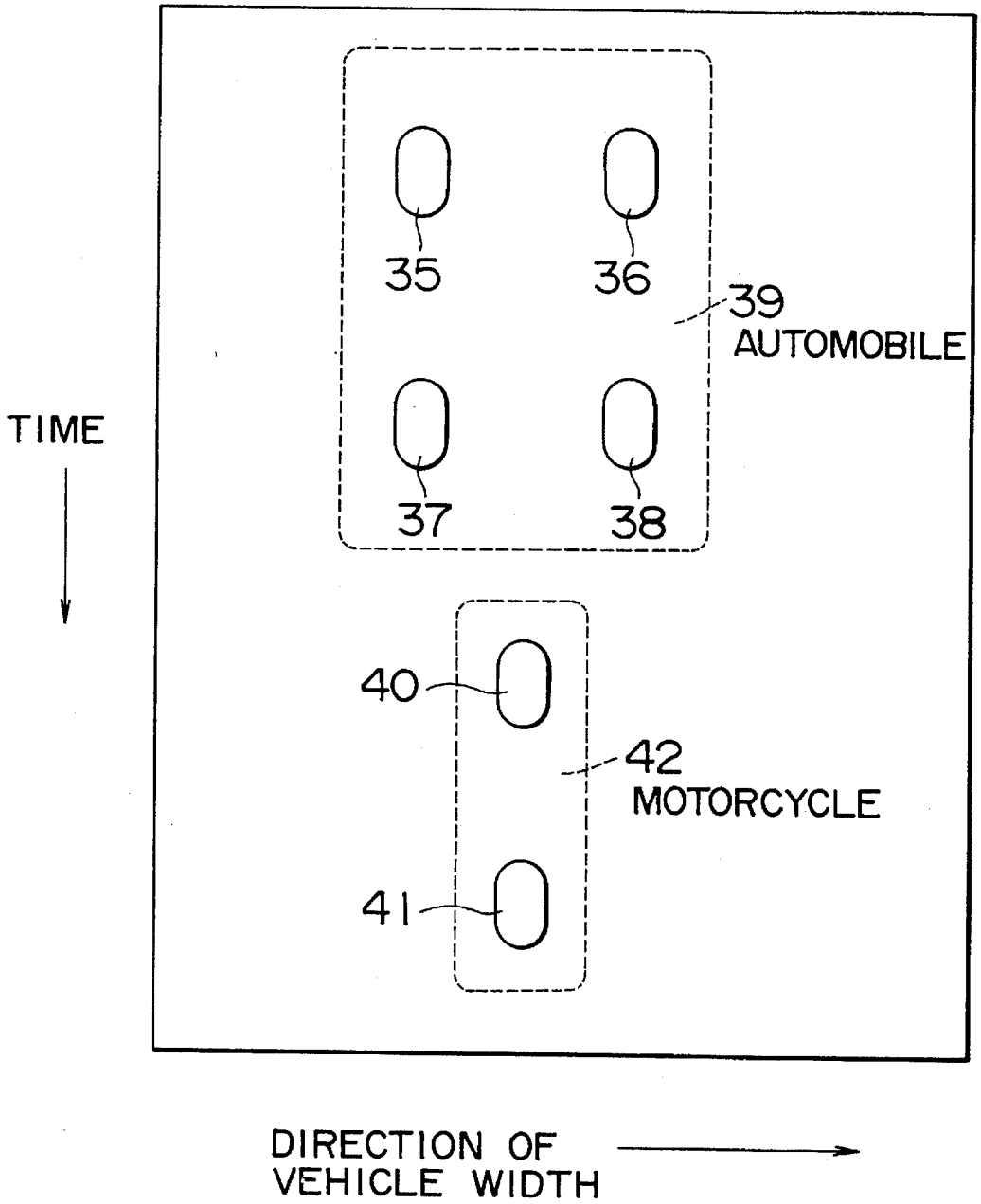
FIG. 11 is a view showing a typical map of contact information.

FIG. 10 shows the construction of the step board for discriminating vehicle type 30. The step board for discriminating vehicle type 30 is used by being embedded in the road 109 as described above. Within the step board for discriminating vehicle type, a plurality of electrically conductive contacts 31 and 32 are arranged in the vehicle width direction. When the tire 33 of vehicle goes over this contact, a pressure 34 is produced, so that the contact 31 is brought into contact with the contact 32, by which a current is allowed to flow. If this contact information is mapped on a memory, map information consisting of contact information 35 to 38 and 40 and 41 as shown in FIG. 11 is obtained in relation to the elapsed time and vehicle width direction. When four pieces of contact information of 35 to 38 are obtained, a contact information group indicated by reference numeral 39 is recognized from this arrangement, so that it can be judged that the vehicle is a passenger car. When two pieces of contact information of 40 and 41 are obtained, a contact information group indicated by reference numeral 42 is recognized from this arrangement, so that it can be judged that the vehicle is a motorcycle.

Figure 12:
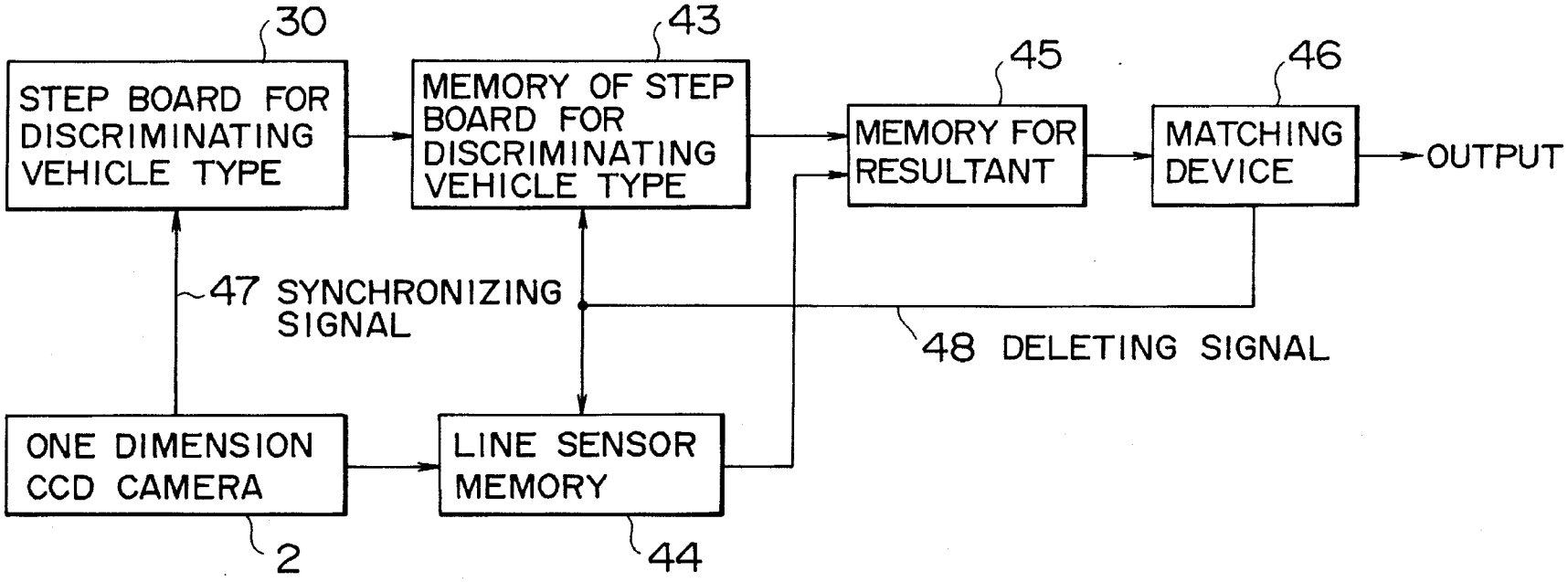
FIG. 12 is a block diagram showing a typical configuration of a signal processing device.

FIG. 12 shows a typical configuration of the signal processing device 5. The device comprises a memory 43 of step board for discriminating vehicle type 30, a line sensor memory 44 for one dimension CCD camera 2, a memory for resultant 45, and a matching device 46. The more detailed configuration is as shown in FIG. 13. Comparing with FIG. 5, the one dimension memory 17 in FIG. 5 corresponds to the line sensor memory 44 in FIG. 13. Instead, the memory for resultant 45 in FIG. 13 corresponds to the one dimension memory 17 in FIG. 5. The function of the matching device 46 is performed by a computer 19.

Figure 14:
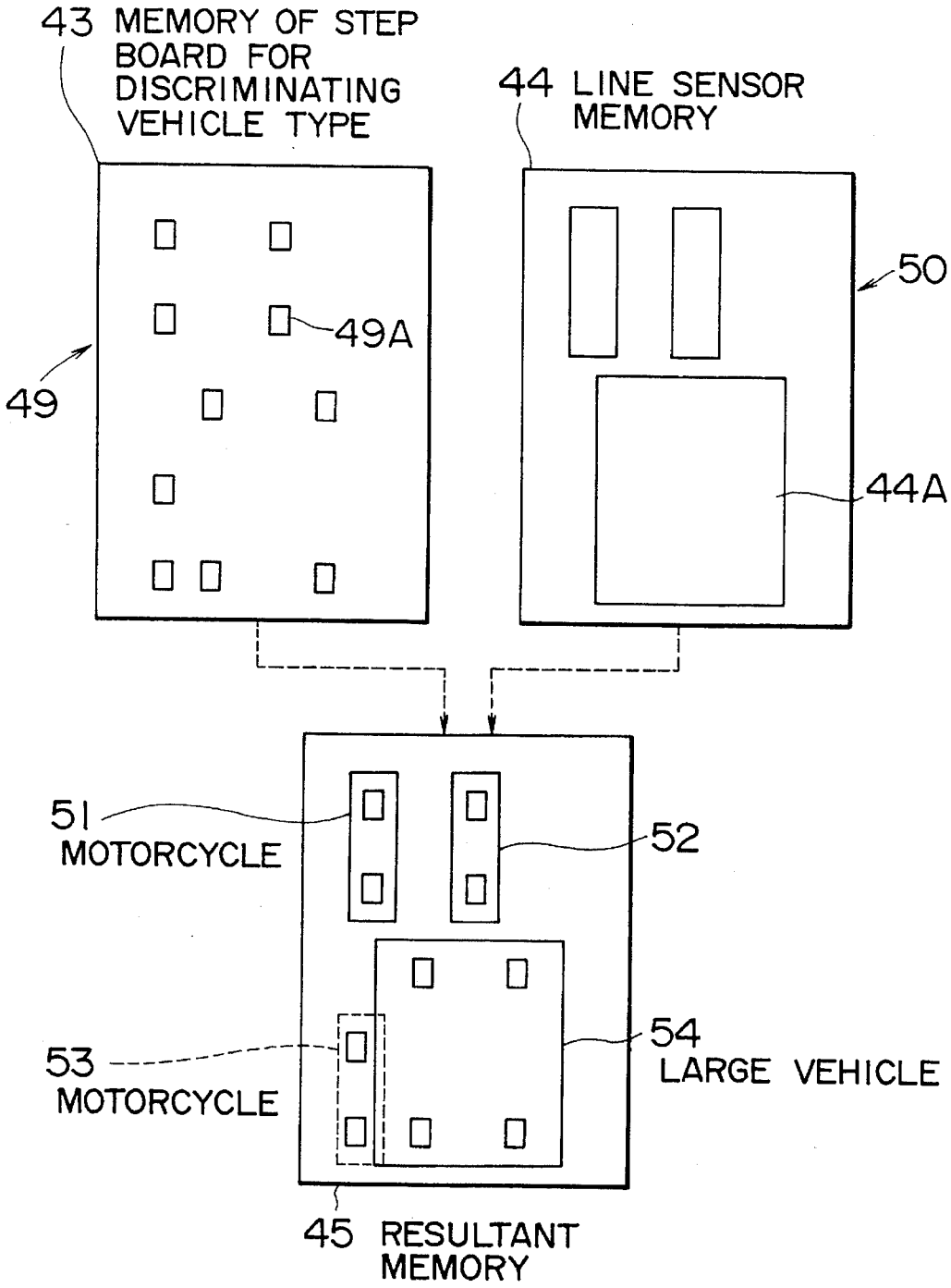
FIG. 14 is a view for illustrating the action of a signal processing device.

The vehicle detecting system of this embodiment will be described with reference to FIG. 12. In FIG. 12, the tire of a passing vehicle applies a pressure to the step board for discriminating vehicle type 30, making the contacts in the step board for discriminating vehicle type 30 conductive. Synchronizing with a synchronizing signal 47 sent from the one dimension CCD camera 2, the system transmits the conductive and non-conductive states of contacts in the vehicle width direction, that is, the contacts information, to the memory 43 of step board for discriminating vehicle type. Then, map information 49 as shown in FIG. 14 can be obtained in the memory 43 of step board for discriminating vehicle type as time elapses. Reference character 49A denotes contact ON information.

The image contour of a vehicle passing through the step board for discriminating vehicle type 30 is detected by using the one dimension CCD camera 2 on the gantry 1, as with the embodiment described earlier, and is stored in the line sensor memory 44. Thus, map information 50 as shown in FIG. 14 can be obtained in the line sensor memory 44 as time elapses. Reference character 44A denotes a non-"0" area. At this time, a synchronizing signal 47 is sent from the CCD camera 2 to the step board for discriminating vehicle type 30 as described above to synchronize the time of the step board for discriminating vehicle type 30 with the time of the CCD camera 2.

The memory for resultant 45 stores the overlapped contents of two memories 43 and 44. The matching device 46 recognizes, from the content of the memory for resultant 45, that the area denoted by 51 and 52 in FIG. 14 indicates two motorcycles, not one passenger car, and recognizes that the area denoted by 54 indicates one large vehicle. Further, the matching device 46 recognizes that a vehicle in the shadow of a large vehicle, which is not found by the one dimension CCD camera 2 only as shown by the area denoted by 53 in FIG. 14, is a motorcycle by comparing the content of the memory 43 of step board for discriminating vehicle type with that of the line sensor memory 44.

When the vehicles do not move due to traffic jam, the memory 43 of step board for discriminating vehicle type and the line sensor memory 44 store the same information only. In this case, the memory capacity comes short, causing the overflow of memory. To overcome this problem, in this embodiment, the matching device 46 receives vehicle width information from the memory 43 of step board for discriminating vehicle type, and predicts the vehicle length from the general ratio of vehicle width to length. If the memory content longer than the predicted vehicle length continues, the matching device 46 generates a deleting signal 48 to delete unnecessary memory data in the elapsed time direction from the memories 43 and 44. Thus, for example, even if a passenger car stops due to traffic jam, it is not mistaken for a trailer truck, etc. Also, if the data entered into the memory 43 of step board for discriminating vehicle type or the line sensor memory 44 do not change for a certain period of time, the deleting signal 48 is generated likewise to delete the monotonous memory data. This eliminates the overflow of memory.

With the vehicle detecting system of the above-described embodiment, the step board for discriminating vehicle type 30 detects the vehicle width and the number of axles on the basis of the vehicle tire, and the contact information is stored in the memory 43 of step board for discriminating vehicle type. On the other hand, the one dimension CCD camera 2 catches the image of a vehicle, and the image information is stored in the line sensor memory 44. At this time, a scanning signal is sent from the one dimension CCD camera 2 to the step board for discriminating vehicle type 30 as a synchronizing signal 47. In the step board for discriminating vehicle type 30, the contact information of the step board for discriminating vehicle type 30 is sampled. The contents of these two memories 43 and 44 are combined by the memory for resultant 45, and the matching device 46 detects a vehicle by judging the type and number of passing vehicles. Therefore, there is no possibility that motorcycles going side by side are mistaken for a passenger or that a motorcycle in the shadow of a large vehicle is missed. Also, by generating the deleting signal 48 from the matching device 46, the overflow of memory caused by unnecessary information in traffic jam can be prevented.

Thus, the use of the step board for discriminating vehicle type 30 as an auxiliary sensor for vehicle detection permits accurate determination of the type and number of passing vehicles, so that non-attendant operation of toll machines on toll roads can be greatly promoted.

Although the step board for discriminating vehicle type 30 was used as an auxiliary sensor for vehicle detection in the above-described embodiment, a not illustrated loop coil, ultrasonic wave transmitter/receiver, or microwave transmitter/receiver may be used.

(1) The loop coil is embedded in appropriate numbers in the road surface under the intermittent markings 6 in order to react to a vehicle. Even if the intermittent marking 6 is hidden by a dropped cardboard box, a person, or dirt and dust, and the one dimension CCD camera 2 regards it as a vehicle, the loop coil does not react to such a thing. Therefore, the loop coil gives the signal processing device 5 a discriminating function such that a vehicle is not detected unless there is detection output of loop coil.

(2) The ultrasonic wave transmitter/receiver is installed on, for example the gantry 1 so as to provide a detection area on the intermittent markings 6 in order to detect a passing vehicle. The ultrasonic wave transmitter/receiver detects a person in addition to vehicles, but the presence of dirt and dust provides the same detecting signal as that of the road surface. Even if the intermittent marking 6 is hidden by dirt and dust, and the one dimension CCD camera 2 regards it as a vehicle, the ultrasonic wave transmitter/receiver does not react to such a thing. Therefore, the ultrasonic wave transmitter/receiver gives the signal processing device 5 a discriminating function such that a vehicle is not detected unless there is vehicle detection output of ultrasonic wave transmitter/receiver.

(3) The microwave transmitter/receiver is also installed on, for example, the gantry 1 so as to provide a detection area on the intermittent markings 6 in order to detect a passing vehicle. The microwave transmitter/receiver detects vehicles or other moving objects. However, the presence of a person, a cardboard box, or dirt and dust provides the same detecting signal as that of the road surface. Even if the intermittent marking 6 is hidden by dirt and dust, a person, or a cardboard box, and the one dimension CCD camera 2 regards it as a vehicle, the microwave transmitter/receiver does not react to such a thing. Therefore, the microwave transmitter/receiver gives the signal processing device 5 a discriminating function such that a vehicle is not detected unless there is vehicle detection output of microwave transmitter/receiver.

Second Embodiment

Figure 15:
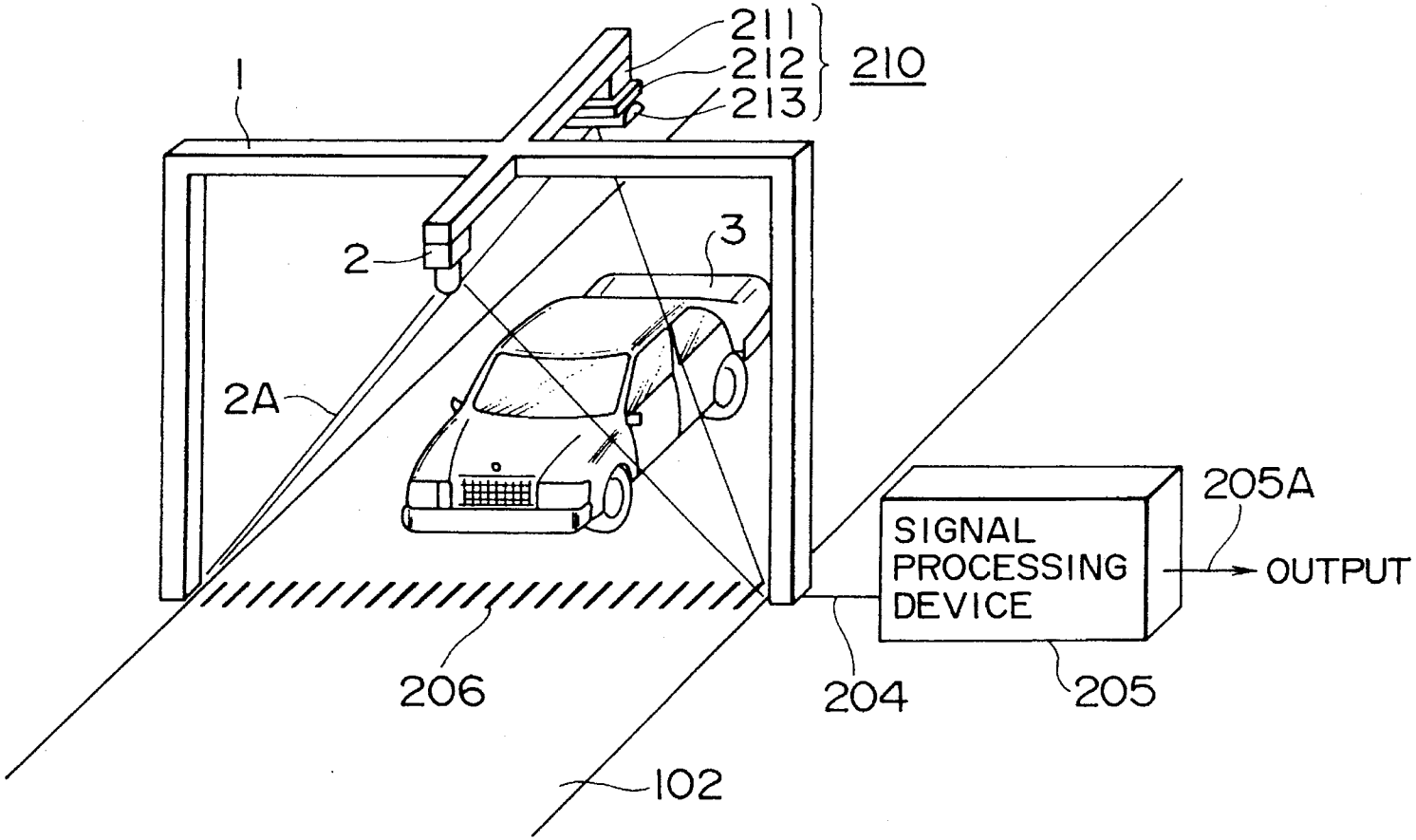
FIG. 15 is a schematic view of a vehicle detecting system in accordance with a second embodiment of the present invention.
Figure 16A:
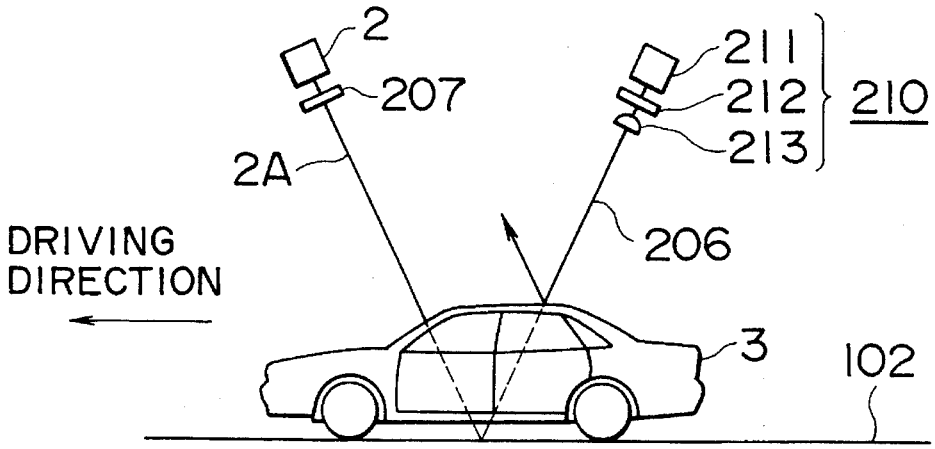
FIGS. 16*a* and 16*b* are a view showing the condition of intermittent marking images in the case where a vehicle passes through, FIGS. 17*a* and 17*b* are a view showing a typical waveform of incident light.
Figure 16B:
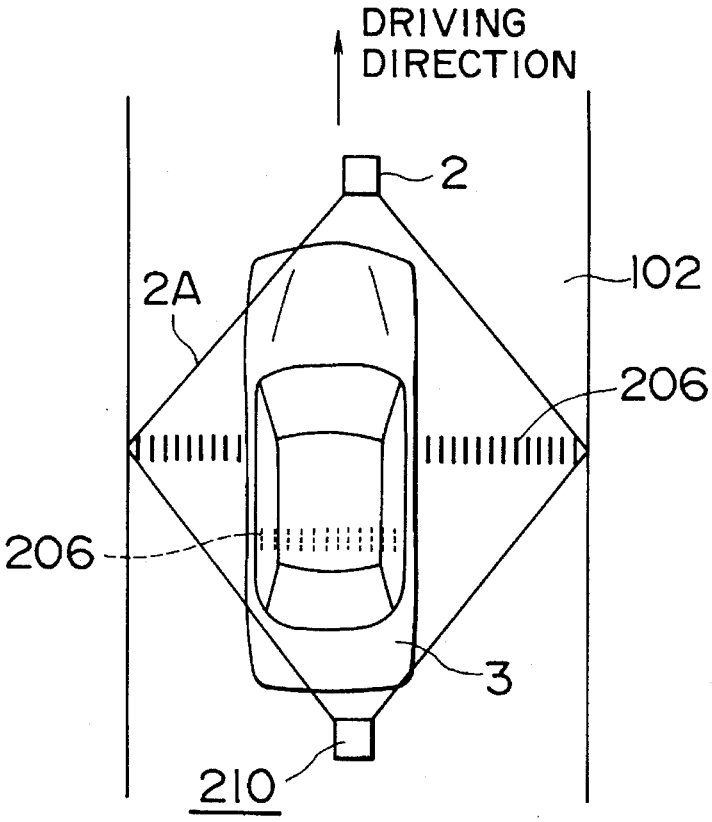

A second embodiment of the present invention will be described with reference to the drawings. FIG. 15 is a schematic view of a vehicle detecting system in accordance with the second embodiment of the present invention. In FIG. 15, a gantry 1 is used to install equipment 2 and 210 above a road surface 102. The equipment 2 consists generally of optical equipment such as an optical array sensor and a lens. In this embodiment, the equipment 2 consists of a one dimension CCD (Charge Coupled Device) camera incorporating a one dimension CCD optical element. The one dimension CCD camera 2 is installed facing obliquely below for each lane. Each one dimension CCD camera 2 is provided with a filter 207 as shown in FIG. 16 to eliminate the effect of light other than laser beam. Each one dimension CCD camera 2 provides a field of view 2A of one dimension in the lane width direction in relation to the road surface 102. A plurality of one dimension CCD cameras may be used to provide a field of view covering the width of one lane. Reference numeral 3 denotes a passing vehicle. The output signal from the one dimension CCD camera 2 is transmitted to a signal processing device 205 via a cable 204, and the signal processing device 205 detects the passing vehicle 3. The signal processing device 205 outputs a pulse signal 205A each time one vehicle passes through.

The equipment 210 is a marking projecting device, which faces obliquely below so as to project intermittent marking images 206 on the road surface 102. The marking projecting device 210 comprises a cylindrical lens 213 as well as a laser spot light source 211 and a diffraction grating 212 in this embodiment. The diffraction grating 212 changes the laser spot light source 211 into intermittent marking images. The cylindrical lens 213 changes the intermittent marking images of dotted line pattern into the intermittent marking images 206 of stripe pattern. The widening of the width of stripe pattern facilitates the installation and adjustment of the one dimension CCD camera 2. The intermittent marking images 206 are formed in the lane width direction.

The one dimension CCD camera 2 and the marking projecting device 210 are installed spacedly in the lane direction so that their optical axes face inside with each other. Therefore, only when the intermittent marking images 206 from the marking projecting device 210 are reflected by the road surface, the one dimension CCD camera 2 catches the intermittent marking images 206.

Figure 17A:
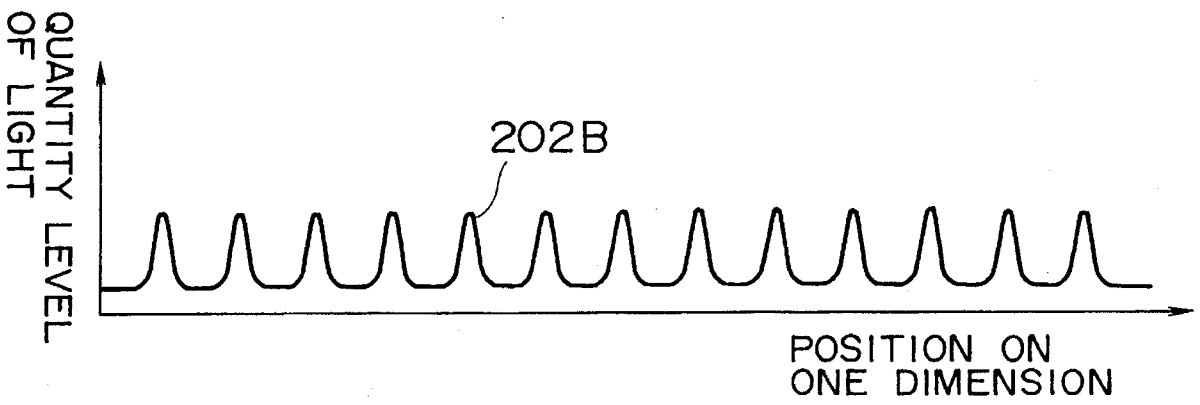
Figure 17B:
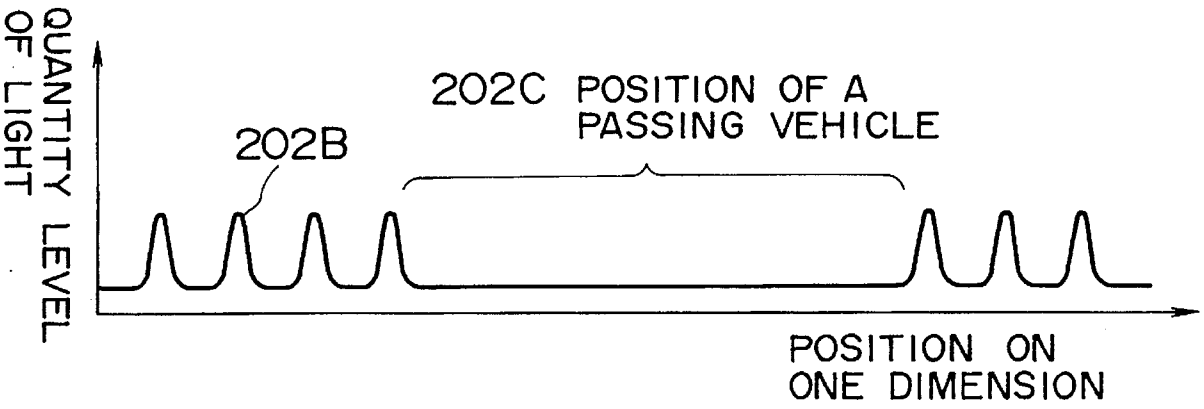

Next, the function of the aforesaid intermittent marking images 206 will be described with reference to FIGS. 16 and 17. FIG. 17 shows an example of the output signal 202B generated when the one dimension CCD camera 2 catches the road surface. As shown in FIG. 16, when a vehicle 3 passes through, the marking images 206 at the passed position disappears from the field of view of the one dimension CCD camera 2 because they are reflected by the vehicle 3. Therefore, the output signal 202B of the one dimension CCD camera 2 changes from FIG. 17(*a*) to 17(*b*). Thus, the position which the vehicle 3 passes through is found from the position 202C where the intermittent marking images 206 in the output signal 202B disappear. For example, even if two motorcycles go side by side, these can be separately detected since the intermittent marking images 206 disappear at two positions. When there is no passing vehicle on the lane directly under the one dimension CCD camera 2 and a large truck passes through on the adjacent lane, the shadow of the truck is cast on the field of view of the one dimension CCD camera 2 depending on the direction of sun light. In this case, the intermittent marking images 206 do not disappear even in the shadow area, so that it is found that there is no vehicle on this lane.

As described above, vehicles can be accurately detected by detecting the presence of the intermittent marking images 206.

Figure 18:
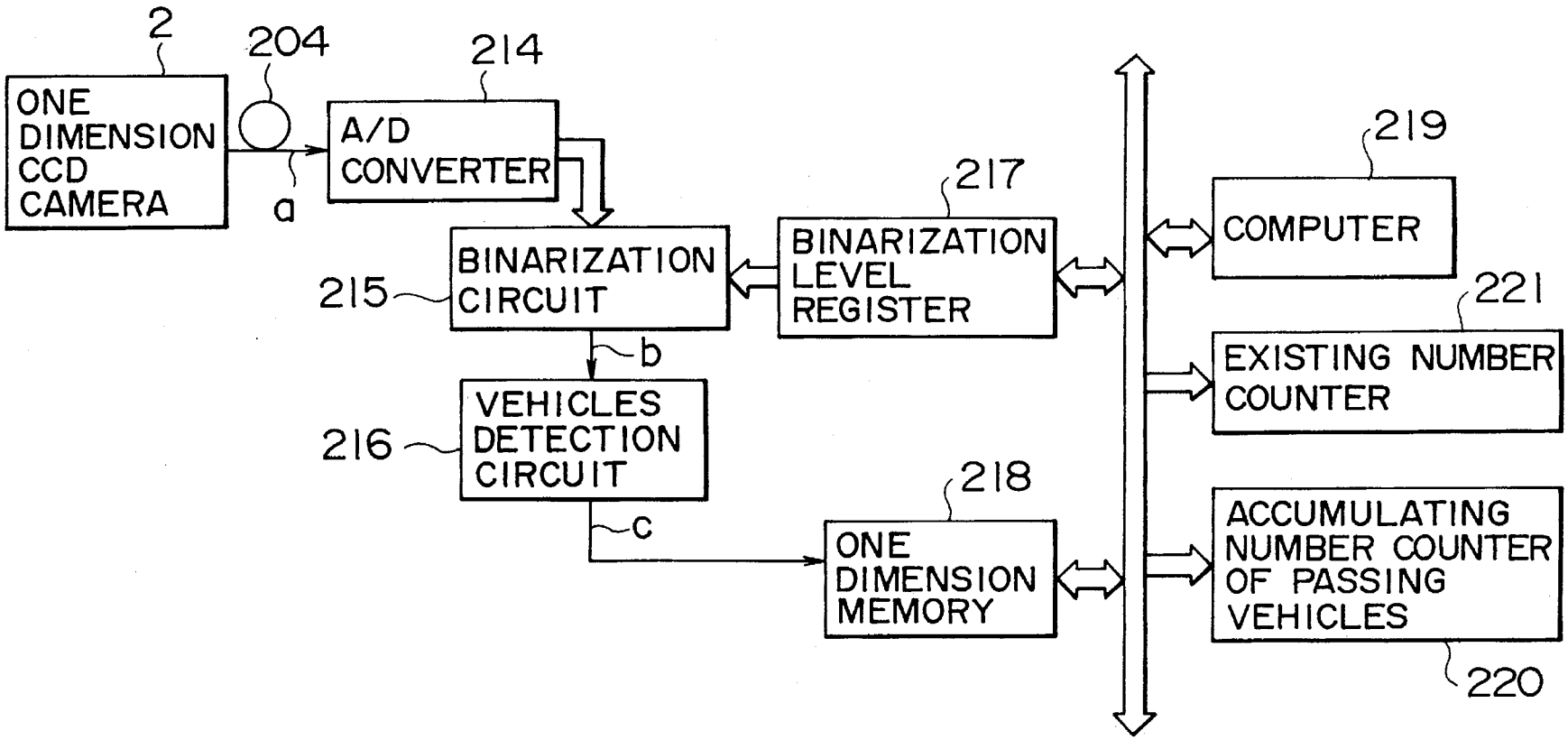
FIG. 18 is a block diagram showing a typical configuration of a signal processing device.

Next, a specific example of a signal processing device 205 will be described with reference to FIG. 18. The signal processing device 205 comprises an A/D converter 214, a binarization circuit 215, a vehicles detection circuit 216, a binarization level register 217, a one dimension memory 218, and a computer 19. Further, the signal processing device 205 comprises an accumulating number counter 220 of passing vehicles and an existing number counter 221 as display devices.

Figure 19A:
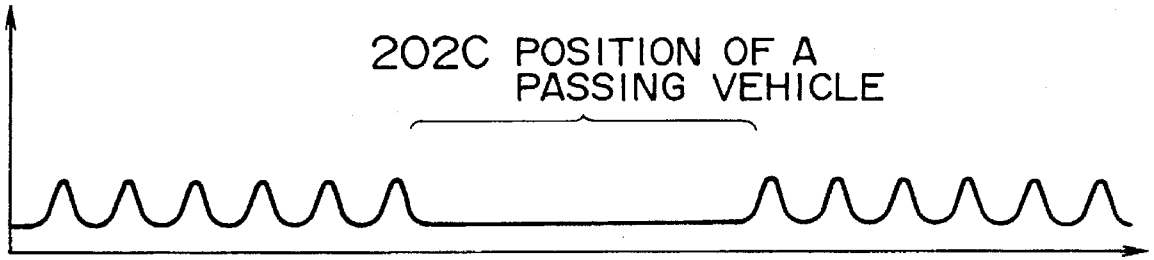
FIGS. 19*a*, 19*b*, and 19*c* are a view showing typical waveforms at portions of the signal processing device.
Figure 19B:
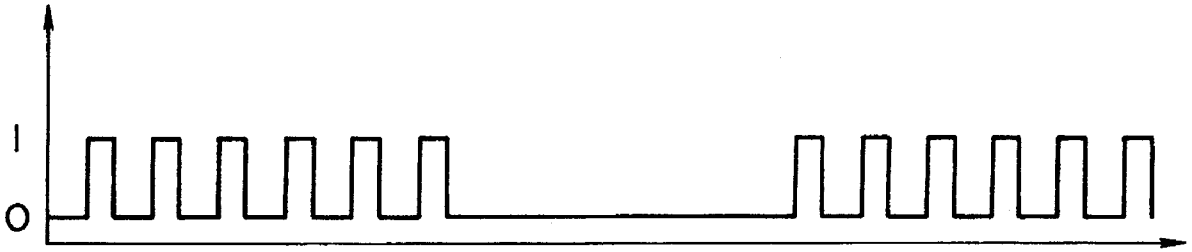
Figure 19C:
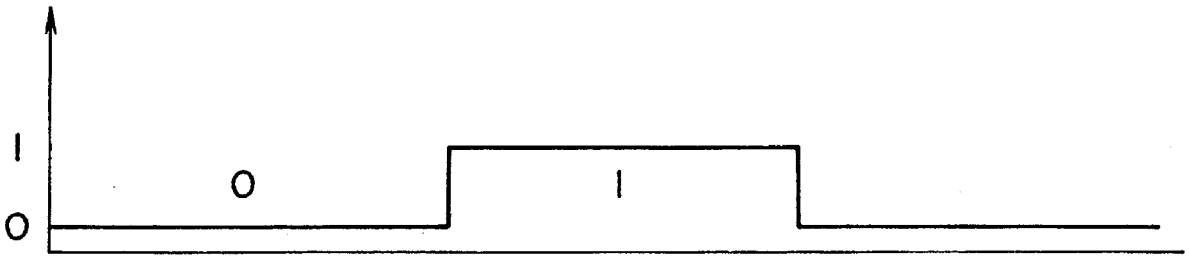

The operation of the signal processing device 205 will be described. First, the output signal a of the one dimension CCD camera 2 is converted into a digital signal by the A/D converter 214. In the threshold signal b of the binarization level register 217, if "1" appears within a certain period, non-"1", that is, "0", is outputted, while if not, "1" is , outputted. The vehicles detection circuit 216 stores the output signal c in the one dimension memory 218. FIG. 19 shows the waveforms of the signals a, b, and c in the signal processing device 205 shown in FIG. 18. On the waveform of the signal c of the vehicles detection circuit 216, the position where a vehicle 3 passes through is indicated by non-"0", that is, "1", and the position where a vehicle 3 does not pass through is indicated by "0". By comparing this signal with the signal obtained in the last detection with the computer 219, the vehicle 3 is discriminated and the accumulating number of passing vehicles is counted. Then, the accumulating number of passing vehicles is displayed on the accumulating number counter 220 of passing vehicles.

Figure 20A:
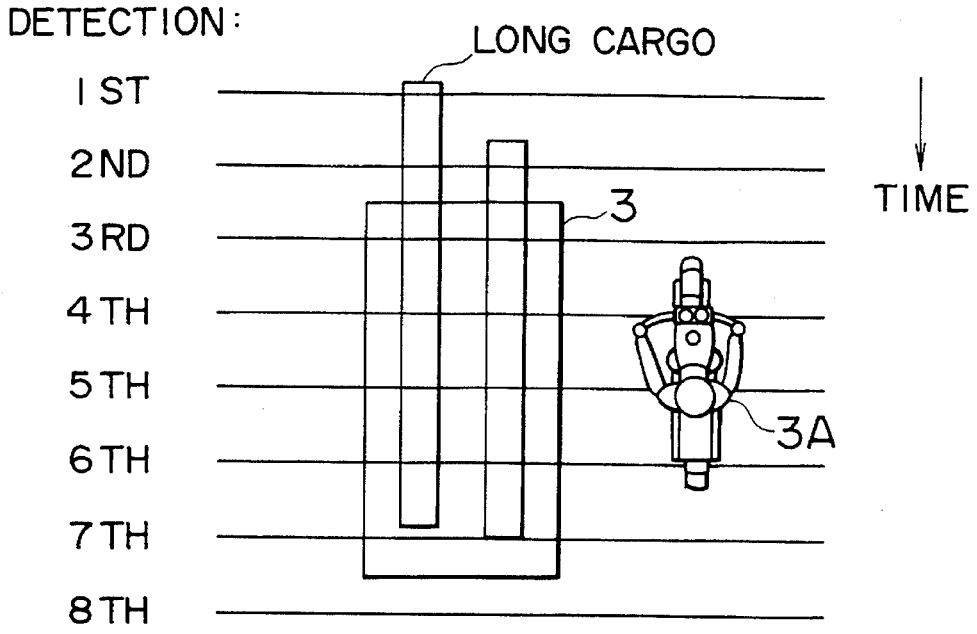
FIGS. 20*a* and 20*b* are a view showing the content of one dimension memory.
Figure 20B:
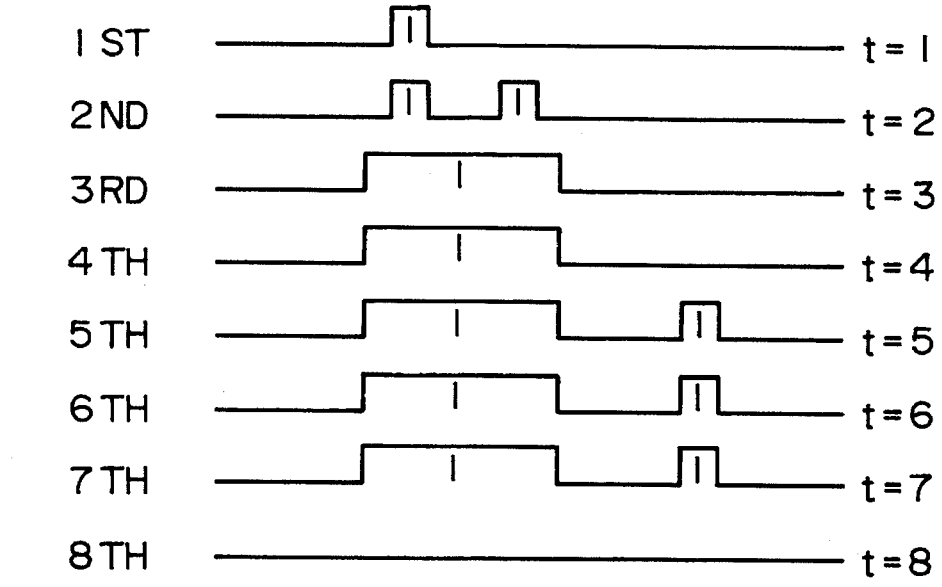

The vehicle detection logic by the computer 219 using the signal waveform at point c mentioned before will be described below. FIG. 20(*a*) shows a truck 3 loaded with pillars on its bed and a motorcycle 3*a* which go side by side. In this figure, the signal of one dimension CCD camera 2 is inputted eight times. Thus, the data of the one dimension memory 218 is as shown in FIG. 20(*b*). If there are two positions of non-"0", that is, "1", the computer 219 judges that two vehicles are passing through. If the position of "1" overlaps with the signal of last detection, the position is regarded as the same vehicle. Therefore, in the second detection, it is judged that two vehicles are passing through, and the third detection indicates one vehicle 3. In the fifth detection, it is judged that two vehicles 3 and 3A are passing through, and in the eighth detection, it is judged that two vehicles 3 and 3A have passed through.

Next, the vehicle detecting procedure in the computer 219 will be described with reference to FIGS. 20 and 8. FIG. 20 shows the content of one dimension memory 218 on a time basis, and FIG. 8 shows the flowchart for the vehicle detecting procedure.

As shown in FIG. 20, even if the content of the one dimension memory 218 is non-"0" as t=1 due to one vehicle 3, when "1" region takes place at another position of the one dimension memory 218 with "0" being interposed as t=2, the coming of another vehicle is detected. The computer 219 checks the content of the one dimension memory 218 each time the content thereof is updated. When it is found that there are groups of "1" separated into two regions, and these two groups are merged into one thereafter as t=3, the computer 219 rejudges that this indicates one vehicle 3. That is to say, the judgment ends when the vehicle 3 leaves, not when the content of the one dimension memory 218 changes from all "0" to non-"0". If non-"0" area is changed into "0" in sequential updating and judgment, the computer 219 judges that the vehicle has passed through the detection region, canceling the output signal. The detection of the coming of vehicle includes the detection of the first and second vehicles, and the leaving of vehicle is also detected for each of detected vehicles 3 and 3A. Thus, the computer 219 judges the content of the one dimension memory 218 while comparing it with the content of the one dimension memory 218 obtained in the last detection. This means judgment by labeling each vehicle.

The output from the computer 219 is provided through an accumulating number counter 220 of passing vehicles and an existing number counter 221. The accumulating number counter 220 of passing vehicles counts up successively when one vehicle is detected. Therefore, this counter 220 indicates the accumulated number of passing vehicles. The existing number counter 221 indicates the number of vehicles which are present in the field of view of the CCD camera 2. Therefore, this counter 221 displays 2 when two motorcycles go side by side.

The processing in the aforesaid computer 219 is the same as described in the above-described first embodiment with reference to the flowchart shown in FIG. 8; therefore, its description is omitted here.

The size of the one dimension memory 218 is determined in relation to the number of picture elements of the photosensor composing the one dimension CCD camera 2. In principle, when a CCD camera with 1000 picture elements is used, the one dimension memory 218 should have a capacity of 1000 bits. In the case where the one dimension CCD camera 2 has 1000 picture elements, when the road width is 5000 mm, one picture element corresponds to 5 mm on the road surface.

Therefore, the period interval of intermittent marking images 206 should be larger than 5mm corresponding to one picture element, and be smaller than the width of small vehicle such as a motorcycle. In the present invention, since a vehicle is detected by the presence of period signal in the output signal from the optical array sensor, if a vehicle with a minimum width of 500 mm is to be detected, marking images having period intervals of about 2 to 5 periods per 500 mm are needed. If the marking images 206 have intervals of 5 periods, the period interval of the marking images 206 on the road surface is 100 mm. That is to say, the period interval of the marking images 206 is larger than one picture element of the CCD camera 2 and smaller than the minimum width of the passing vehicle 3.

As described above, by using a one dimension CCD camera 2 and marking projecting device 210, a vehicle can be detected accurately even under special conditions where vehicles go side by side, a motorcycle passes another vehicle in a traffic jam, or a shadow is cast on the road surface when the vehicle detecting system is applied to toll machines using a wireless IC card on the main lane of toll road or applied to traffic survey.

Next, a vehicle detecting system in accordance with another embodiment of the present invention will be described with reference to FIGS. 21, 10 to 12, 22, and 14.

Figure 21:
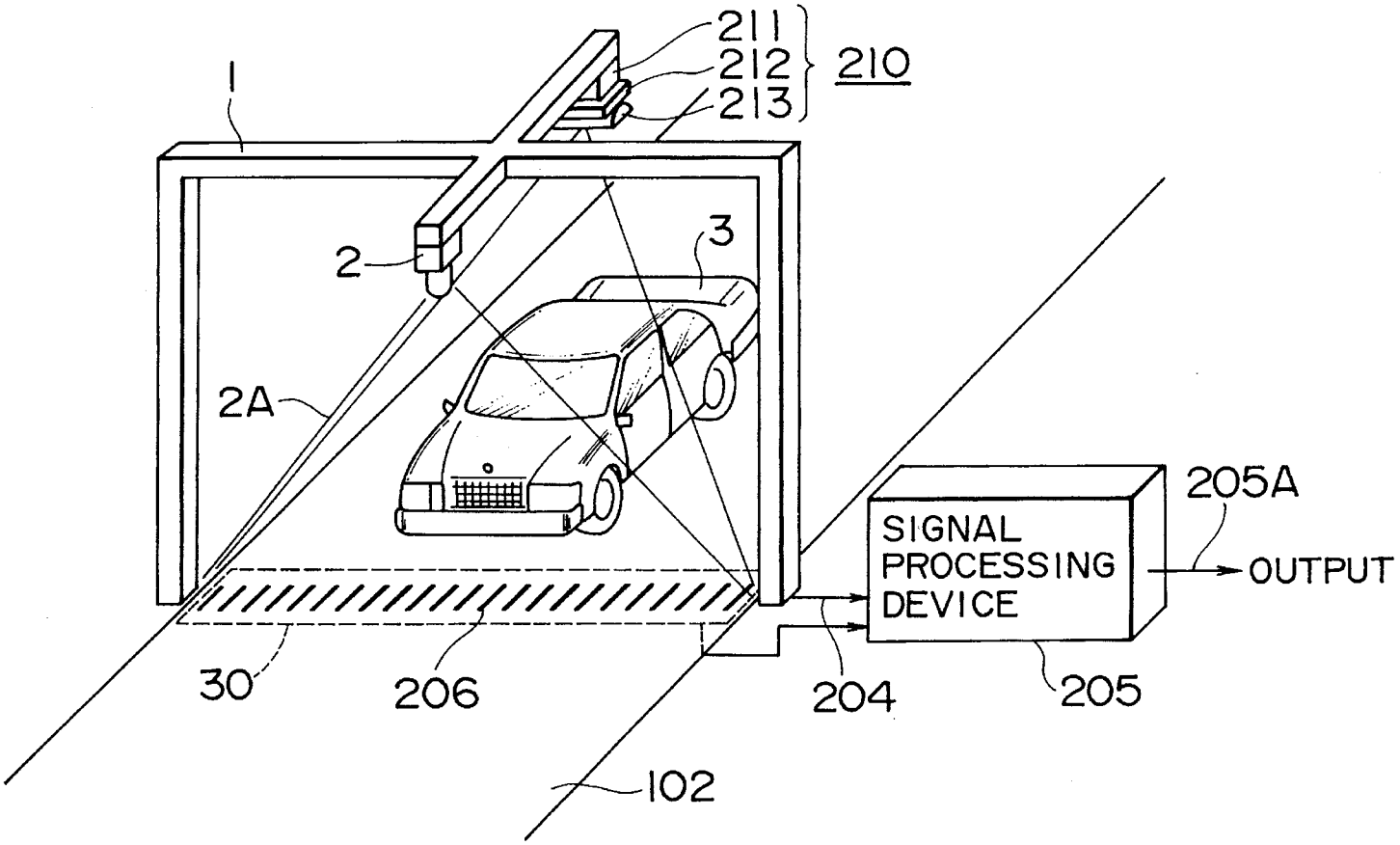
FIG. 21 is a schematic view of a vehicle detecting system in accordance with another embodiment of the present invention.

With the vehicle detecting system shown in FIG. 21, one or more step board for discriminating vehicle type 30 are embedded in the road surface in the field of view of the one dimension CCD camera 2 as an auxiliary sensor for detecting a vehicle, in addition to the one dimension CCD camera 2, the signal processing device 5, and the marking projecting device 210 shown in FIG. 15. The signal processing device 205 detects a vehicle by using not only the signal sent from the one dimension CCD camera 2 but also the signal sent from the step board for discriminating vehicle type 30.

The construction of the step board for discriminating vehicle type 30 is the same as described in the above-described first embodiment with reference to FIG. 10; therefore, its description is omitted here.

Figure 22:
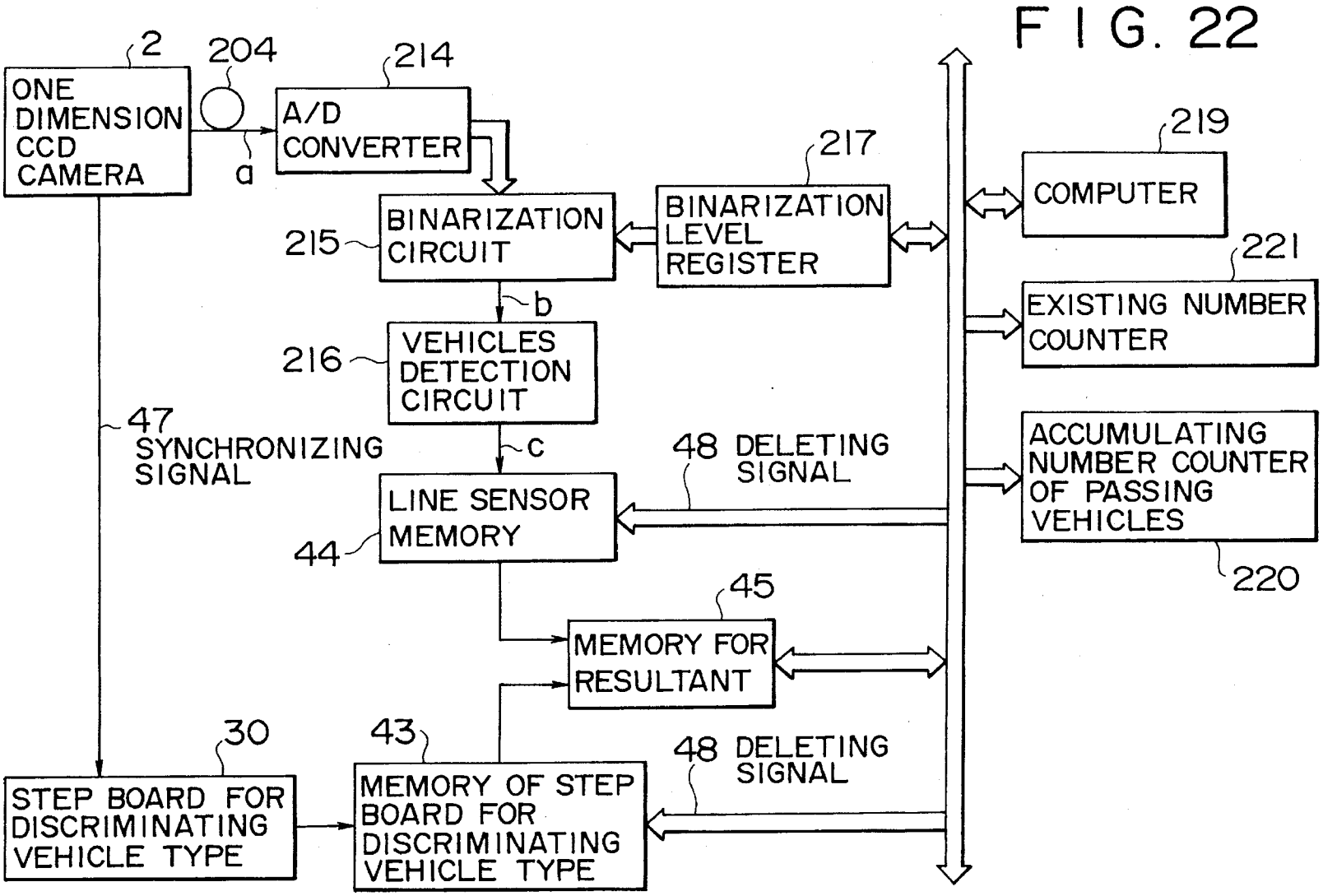
FIG. 22 is a block diagram showing a typical configuration of a signal processing device, corresponding to FIG. 18.

FIG. 12 shows a typical configuration of the signal processing device 205. The device 205 comprises a memory 43 of step board for discriminating vehicle type 30, a line sensor memory 44 for one dimension CCD camera 2, a memory for resultant 45, and a matching device 46. The more detailed configuration is as shown in FIG. 22. Comparing with FIG. 18, the one dimension memory 218 in FIG. 18 corresponds to the line sensor memory 44 in FIG. 22. Instead, the memory for resultant 45 in FIG. 22 corresponds to the one dimension memory 218 in FIG. 18. The function of the matching device 46 is performed by a computer 219.

The vehicle detecting system of this embodiment is the same as described in the above-described first embodiment with reference to FIG. 12.

Although the step board for discriminating vehicle type 30 was used as an auxiliary sensor for vehicle detection in the above-described embodiment, a not illustrated loop coil, ultrasonic wave transmitter/receiver, or microwave transmitter/receiver may be used.

(1) The loop coil is embedded in appropriate numbers in the road surface on which intermittent marking images 206 are projected in order to react to a vehicle. Even if the intermittent marking image 206 is hidden by the reflection due to a dropped cardboard box, a person, or dirt and dust, and the one dimension CCD camera 2 regards it as a vehicle, the loop coil does not react to such a thing. Therefore, the loop coil gives the signal processing device 205 a discriminating function such that a vehicle is not detected unless there is detection output of loop coil.

(2) The ultrasonic wave transmitter/receiver is installed on, for example, the gantry 1 so as to provide a detection area on the intermittent marking images 206 in order to detect a passing vehicle. The ultrasonic wave transmitter/receiver detects a person in addition to vehicles, but the presence of dirt and dust provides the same detecting signal as that of the road surface. Even if the intermittent marking image 206 is hidden by the reflection due to dirt and dust, and the one dimension CCD camera 2 regards it as a vehicle, the ultrasonic wave transmitter/receiver does not react to such a thing. Therefore, the ultrasonic wave transmitter/receiver gives the signal processing device 205 a discriminating function such that a vehicle is not detected unless there is vehicle detection output of ultrasonic wave transmitter/receiver.

(3) The microwave transmitter/receiver is also installed on, for example, the gantry 1 so as to provide a detection area on the intermittent marking images 206 in order to detect a passing vehicle. The microwave transmitter/receiver detects vehicles or other moving objects. However, the presence of a person, a cardboard box, or dirt and dust provides the same detecting signal as that of the road surface. Even if the intermittent marking image 206 is hidden by the reflection due to dirt and dust, a person, or a cardboard box, and the one dimension CCD camera 2 regards it as a vehicle, the microwave transmitter/receiver does not react to such a thing. Therefore, the microwave transmitter/receiver gives the signal processing device 205 a discriminating function such that a vehicle is not detected unless there is vehicle detection output of microwave transmitter/receiver.

We claim:

1. A vehicle detecting system comprising, an optical array sensor which is disposed above a road surface to receive a one dimension light amount signal in the lane width direction from the road surface; an optical equipment which is mounted to said optical array sensor; intermittent markings which are disposed at fixed intervals on the road surface in the one dimension field of view of said optical array sensor; and a signal processing device which detects vehicles passing through on said road surface by processing an output signal sent from said optical array sensor;

wherein the intermittent period interval of said intermittent markings is longer than the on-road period interval of the picture elements of said optical array sensor, and shorter than the minimum width of the vehicle to be detected.

2. A vehicle detecting system according to claim 1 wherein said vehicle detecting system further includes at least one sensor out of a step board which is embedded in the road surface and has a contact operated by a vehicle wheel, a loop coil which is embedded in the road surface, an ultrasonic wave transmitter/receiver which is mounted above the road surface, and a microwave transmitter/receiver which is mounted above the road surface, so that said signal processing device detects vehicles from the output signal of said one sensor and the output signal of said optical array sensor.

3. A vehicle detecting system according to claim 1 wherein said signal processing device detects said vehicles passing through on said road surface by comparing a standard signal pattern from said optical array sensor which is modulated intermittently by said markings in the case where no vehicle is present with the output signal pattern in the case where a vehicle passes through.

4. A vehicle detecting system comprising, a marking projecting device which includes a laser light source and a diffraction grating mounted above a road surface in order to project stripe-pattern intermittent marking images in the lane width direction onto the road surface; an optical array sensor which is mounted above the road surface so as to have an optical axis in a nonparallel arrangement with the optical axis of said marking projecting device, and receives a one dimension light amount signal of said intermittent marking images in the lane width direction from the road surface; an optical equipment which is mounted to said optical array sensor; and a signal processing device which detects vehicles passing through on said road surface by processing an output signal sent from said optical array sensor;

wherein the intermittent period interval of said intermittent marking images is longer than the on-road period interval of the picture elements of said optical array sensor, and shorter than the minimum width of the vehicle to be detected.

5. A vehicle detecting system according to claim 4 wherein said vehicle detecting system further includes at least one sensor out of a step board which is embedded in the road surface and has a contact operated by a tire of vehicle, a loop coil which is embedded in the road surface, an ultrasonic wave transmitter/receiver which is mounted above the road surface, and a microwave transmitter/receiver which is mounted above the road surface, and said signal processing device detects vehicles from the output signal of said one sensor and the output signal of said optical array sensor.

6. A vehicle detecting system according to claim 4 wherein said signal processing device detects said vehicles passing through on said road surface by processing the change of output signal pattern of passing vehicle out of the output signal patterns from said optical array sensor which are modulated intermittently by said marking image when no vehicle is present.

* * * * *